US010287722B2

(12) United States Patent
Kim et al.

(10) Patent No.: US 10,287,722 B2
(45) Date of Patent: May 14, 2019

(54) WASHING MACHINE

(71) Applicant: SAMSUNG ELECTRONICS CO., LTD., Suwon (KR)

(72) Inventors: Jun Ho Kim, Suwon (KR); Chang Yeong Kim, Seoul (KR); Hyeon Cheol Kim, Seoul (KR); Goan Su Jung, Yeosu (KR); Min Hyung Kim, Seoul (KR); Yong Kwon Won, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 270 days.

(21) Appl. No.: 14/736,755

(22) Filed: Jun. 11, 2015

(65) Prior Publication Data

US 2015/0275412 A1 Oct. 1, 2015

Related U.S. Application Data

(63) Continuation of application No. PCT/KR2015/001506, filed on Feb. 13, 2015.

(30) Foreign Application Priority Data

Feb. 28, 2014 (KR) ..... 10-2014-0024563
May 30, 2014 (KR) ..... 10-2014-0065919

(51) Int. Cl.
*D06F 29/00* (2006.01)
*D06F 37/18* (2006.01)
(Continued)

(52) U.S. Cl.
CPC ..... *D06F 29/00* (2013.01); *D06F 1/04* (2013.01); *D06F 23/04* (2013.01); *D06F 31/00* (2013.01);
(Continued)

(58) Field of Classification Search
CPC . D06F 39/14; D06F 39/12; D06F 1/04; D06F 29/00; D06F 23/04
(Continued)

(56) References Cited

U.S. PATENT DOCUMENTS 94,501 A * 9/1869 Morahan ..... D06F 1/04 68/233
139,684 A * 6/1873 Morahan ..... D06F 1/04 68/233
(Continued)

FOREIGN PATENT DOCUMENTS

CN 202011992 10/2011
EP 1 367 169 A1 12/2003
(Continued)

OTHER PUBLICATIONS

First Action Interview Pilot Program Pre-Interview Communication dated Sep. 25, 2015 in related U.S. Appl. No. 14/736,804.
(Continued)

*Primary Examiner* — David G Cormier
*Assistant Examiner* — Thomas Bucci
(74) *Attorney, Agent, or Firm* — Staas & Hasley LLP

(57) ABSTRACT

Provided is a washing machine including an auxiliary washing unit configured with an auxiliary washing space formed separately from a main washing space formed in a rotating tub, and a discharging assembly by which the auxiliary washing space and the main washing space are selectively in communication with each other. Through such a structure, auxiliary washing may be independently performed, and washing efficiency may be enhanced.

25 Claims, 39 Drawing Sheets

(51) Int. Cl.

| | |
|---|---|
| ***D06F 37/28*** | (2006.01) |
| ***D06F 31/00*** | (2006.01) |
| ***D06F 39/12*** | (2006.01) |
| ***D06F 37/26*** | (2006.01) |
| ***D06F 39/14*** | (2006.01) |
| ***D06F 1/04*** | (2006.01) |
| ***D06F 39/08*** | (2006.01) |
| ***D06F 23/04*** | (2006.01) |

(52) U.S. Cl.
CPC ..... *D06F 37/18* (2013.01); *D06F 37/26* (2013.01); *D06F 37/28* (2013.01); *D06F 39/083* (2013.01); *D06F 39/12* (2013.01); *D06F 39/14* (2013.01)

(58) Field of Classification Search
USPC .. 68/3 R, 233, 196, 13 R, 14, 23.3, 237, 27, 68/142, 38; 312/228, 328, 228.1
See application file for complete search history.

(56) References Cited

U.S. PATENT DOCUMENTS 806,680 A * 12/1905 Kottmeyer ..... D06F 1/04 4/628
1,102,412 A * 7/1914 James ..... E03C 1/186 4/514
1,119,696 A * 12/1914 Hoffman ..... D06F 1/04 68/233
1,152,552 A * 9/1915 Ryder ..... D06F 1/04 160/113
1,209,555 A * 12/1916 Carlson ..... D06F 1/04 4/628
1,240,037 A * 9/1917 Ellis ..... D06F 1/04 68/233
1,373,980 A * 4/1921 Shults ..... D06F 1/04 68/233
1,462,573 A * 7/1923 Hagaman ..... D06F 1/04 68/233
1,483,816 A * 2/1924 Kylar ..... D06F 3/02 68/233
1,814,698 A * 7/1931 Huber ..... D06F 1/04 68/233
1,936,310 A * 11/1933 Rodota ..... D06F 1/04 68/233
3,026,699 A * 3/1962 Rhodes ..... D06F 29/00 68/12.19
3,039,284 A * 6/1962 Shelton ..... D06F 29/00 137/360
3,039,286 A * 6/1962 Shelton ..... D06F 29/00 137/312
3,209,560 A * 10/1965 Shelton ..... D06F 13/00 68/14
3,490,254 A * 1/1970 Mason ..... D06F 13/00 68/14
3,575,020 A * 4/1971 Hubbard ..... D06F 13/00 68/12.19
5,253,493 A * 10/1993 Ohashi ..... D06F 39/14 220/812
5,582,039 A * 12/1996 Mueller ..... D06F 37/12 68/17 R
5,857,363 A * 1/1999 Jung ..... D06F 39/14 160/206
6,102,504 A * 8/2000 Richardson ..... D06F 39/14 312/228
7,296,443 B2 * 11/2007 Usherovich ..... D06F 39/14 312/228.1
7,493,781 B2 * 2/2009 Ooe ..... B08B 3/12 134/184
2002/0134117 A1 * 9/2002 Arai ..... D06F 19/00 68/3 SS
2005/0072194 A1 * 4/2005 Ryohke ..... D06F 19/00 68/3 R
2006/0156763 A1 * 7/2006 Vecchi ..... D06F 19/00 68/3 SS
2010/0251784 A1 * 10/2010 Lee ..... D06F 23/04 68/200
2010/0281927 A1 * 11/2010 Lee ..... D06F 17/04 68/200

FOREIGN PATENT DOCUMENTS

| | | |
|---|---|---|
| JP | 58-8484 | 1/1983 |
| JP | 3-75089 | 3/1991 |
| JP | 6-41688 | 6/1994 |
| JP | 7-20186 | 4/1995 |
| KR | 1999-016037 | 3/1999 |
| KR | 1999-0030944 | 7/1999 |
| KR | 1999-0073964 | 10/1999 |
| KR | 20-0405509 | 1/2006 |
| KR | 20-2013-0001857 | 3/2013 |

OTHER PUBLICATIONS

Machine translation of KR 10-1999-016037, dated Mar. 5, 1999.
Chinese Office Action dated Jun. 28, 2016 in Chinese Patent Application 201580000399.6.
European Search Report dated Sep. 28, 2016 in corresponding European Patent Application No. 15736164.3.
European Office Action dated Oct. 18, 2016 in corresponding European Patent Application No. 15736164.3.
European Office Action dated May 11, 2017, in corresponding European Patent Application No. 15 736 164.3.
Chinese Office Action dated Mar. 3, 2017, in corresponding Chinese Patent Application No. 201580000399.6.
Korean Office Action dated May 15, 2015 in Korean Patent Application No. 9-5-2015-032052723.
International Search Report dated May 22, 2015 in corresponding International Patent Application No. PCT/KR2015/001506.
Notice of Allowance dated Dec. 14, 2015 in related U.S. Appl. No. 14/736,804.
European Intention to Grant dated Jan. 3, 2018, in corresponding European Patent Application No. 15 736 164.3.
Indian Office Action dated Feb. 4, 2019, in corresponding Indian Patent Application No. 1867/MUMNP/2015.

* cited by examiner

WASHING MACHINE

CROSS-REFERENCE TO RELATED APPLICATIONS

This application is a continuation of International Application PCT/KR2015/001506 filed Feb. 13, 2015, and claims foreign priority to Korean application 10-2014-0065919 filed May 30, 2014, and Korean application 10-2014-0024563 filed Feb. 28, 2014, the disclosures of which are incorporated herein by reference in their entireties.

BACKGROUND

1. Field

Embodiments relate to a washing machine, and more particularly, to a washing machine capable of performing auxiliary washing.

2. Description of the Related Art

A washing machine is a machine that washes laundry using electric power, and generally includes a fixed tub in which washing water is stored, a rotating tub that is rotatably installed in the fixed tub, and a pulsator that is rotatably provided at a bottom of the rotating tub.

In general, a washing machine has a washing space formed by the fixed tub and the rotating tub, but no separate space for washing dirt from socks, white clothes, undergarments or the like is formed.

SUMMARY

At least one embodiment is directed to providing a washing machine which has an auxiliary washing unit having an auxiliary washing space for auxiliary washing.

Also, at least one embodiment is directed to providing a washing machine which in which simple hand-washing can be performed.

One aspect of an embodiment provides a washing machine including a main body having an opening; a fixed tub configured to store washing water in the main body; a rotating tub having a main washing space in which laundry is washed, and rotatably provided in the fixed tub; and a door assembly provided at the opening, wherein the door assembly includes a door configured to open and close the opening; and an auxiliary washing unit having an auxiliary washing space for performing auxiliary washing and disposed at an inner side of the door, and the auxiliary washing unit includes a discharging assembly provided to be opened and closed, such that laundry is discharged from the auxiliary washing space to the main washing space.

The auxiliary washing unit may include a unit body configured to form the auxiliary washing space, and an auxiliary opening provided at the unit body to be in communication with the main washing space, and the discharging assembly may be configured to open and close the auxiliary opening.

The discharging assembly may include a discharging door moved between a first position in which the auxiliary opening is closed and a second position in which the auxiliary opening is opened, and a door holder provided at the unit body to guide the discharging door, such that the discharging door is moved between the first position and the second position.

The discharging door may further include a releasing position in which the discharging door is released from the unit body between the first position and the second position so as to be moved from the first position to the second position.

The discharging door may include a door body, a slider provided at one end of the door body to be coupled to the door holder, and a restriction member provided at the other end of the door body to be selectively restricted by the unit body.

The restriction member may be restricted by the unit body when the discharging door is at the first position, and may be separated from the unit body when the discharging door is at the releasing position.

The door holder may include a holder body; a sliding rail formed to extend from the holder body and thus to allow a movement of the slider, and configured so that the discharging door is moved between the first position and the releasing position; and a holder hinge provided at the holder body so that the holder body is hinged to the unit body, and configured so that the discharging door is moved between the releasing position and the second position.

The discharging door may include a door body; and a slider provided at one end of the door body to be movably coupled to the door holder, and the sliding rail may include a first coupling part to which the slider is coupled when the discharging door is at the first position; and a second coupling part to which the slider is coupled when the discharging door is at the releasing position.

The unit body may include a bottom part; and a side part formed to be curved toward the bottom part, and at least a part of the auxiliary opening may be formed at the bottom part.

The auxiliary opening may be formed from the bottom part to an end of the unit body.

The door assembly may be provided to be rotatable with respect to the main body.

The door assembly may be provided to be moved among a closed position in which the door and the auxiliary washing unit are disposed on the opening to close the opening, an auxiliary washing position in which the door rotates from the closed position such that auxiliary washing can be performed in the auxiliary washing unit, and an opened position in which the door and the auxiliary washing unit rotate so as to open the opening.

The auxiliary washing unit may include an auxiliary drain formed at an upper end of the unit body to be more concave downward than an adjacent upper end and thus to drain the washing water used in the auxiliary washing space, and the auxiliary opening may be connected to the auxiliary drain so that a width of the auxiliary drain is expanded when the auxiliary opening is opened by the discharging assembly.

The discharging assembly may include a discharging door configured to open and close the auxiliary opening, and an inner surface and an outer surface of the discharging door are configured with an inner surface configured to form the auxiliary washing space and a surface configured to extend from an outer surface which is an opposite surface to the inner surface.

The discharging door and the unit body may be formed of the same material.

The discharging assembly may include one pair of discharging doors provided to be bilaterally opened centering on the auxiliary opening, and the door holder may include a holder hinge provided between the pair of discharging doors and the unit body so that the pair of discharging doors rotate with respect to the unit body.

The discharging assembly may include a discharging door moved between a first position in which the auxiliary opening is closed and a second position in which the auxiliary opening is opened through a sliding movement of the discharging door from the first position.

The discharging door may be slid toward a lower side of the unit body.

The discharging door may include a moving groove provided at an upper surface thereof, and the discharging assembly may include a door rail provided at a lower surface of the unit body to guide a movement of a moving protrusion.

Another aspect of an embodiment provides a washing machine including a main body having an opening; a fixed tub configured to store washing water in the main body; a rotating tub having a main washing space in which laundry is washed, and rotatably provided in the fixed tub; and a door assembly provided at the opening, wherein the door assembly includes a door configured to open and close the opening; and an auxiliary washing unit having an auxiliary washing space formed at an inner side of a door for auxiliary washing and also having a discharging assembly moved between a first position in which the auxiliary washing space is closed with respect to the main washing space and a second position in which the auxiliary washing space is opened with respect to the main washing space.

The auxiliary washing unit may include a unit body configured to form the auxiliary washing space, and an auxiliary opening provided at the unit body to be in communication with the main washing space, and the discharging assembly may be formed to open and close the auxiliary opening.

The discharging assembly may include a discharging door moved between a first position in which the auxiliary opening is closed and a second position in which the auxiliary opening is opened; and a door holder provided at the unit body so that the discharging door is moved between the first position and the second position.

The discharging door may further include a releasing position in which the discharging door is released from the unit body between the first position and the second position so as to allow the discharging door to be moved from the first position to the second position.

Still another aspect of an embodiment provides a washing machine including a main body having an opening; a fixed tub configured to store washing water in the main body; a rotating tub having a main washing space in which laundry is washed, and rotatably provided in the fixed tub; and a door assembly provided at the opening, wherein the door assembly includes a door configured to open and close the opening; and an auxiliary washing unit having an auxiliary washing space formed for performing auxiliary washing and an auxiliary opening through which the auxiliary washing space is in communication with the main washing space, and also having a discharging assembly configured to open and close the auxiliary opening.

The discharging assembly may include a discharging door moved between a first position in which the auxiliary opening is closed and a second position in which the auxiliary opening is opened through a sliding movement of the discharging door from the first position.

The discharging door may be slid toward a lower side of the unit body.

The discharging door may include a moving groove provided at an upper surface thereof, and the discharging assembly may include a door rail provided at a lower surface of the unit body to guide a movement of a moving protrusion.

Yet another aspect of an embodiment provides a washing machine including a main body having an opening; a fixed tub configured to store washing water in the main body; a rotating tub having a main washing part in which laundry is washed, and rotatably provided in the fixed tub; and a top cover assembly provided at the opening, wherein an auxiliary washing part is formed at at least one surface of the top cover assembly for performing hand-washing.

An inner surface of the top cover assembly may be formed to be inclined downward toward a center.

The auxiliary washing part may be disposed at at least one of inner surfaces of the top cover assembly.

The auxiliary washing part may be disposed at a front surface among the inner surfaces of the top cover assembly.

The auxiliary washing part may include a plurality of frictional protrusions formed to be more convex than the inner surfaces of the top cover assembly and thus to increase frictional force of laundry.

The frictional protrusions may include a straight line or round shape.

The top cover assembly may include an auxiliary washing unit having the auxiliary washing part and detachably provided at the top cover assembly.

The auxiliary washing unit may include a bottom part, a body which is formed to be inclined toward the bottom part and in which the auxiliary washing part is formed at one surface thereof, and a seating part formed at an upper edge of the body.

The top cover assembly may include a seating surface formed along an edge of the opening to correspond to the seating part.

The auxiliary washing unit may include an auxiliary drain through which washing water used in the auxiliary washing space is drained.

The auxiliary washing unit may be formed of an ABS material.

The auxiliary washing unit may be disposed above the rotating tub.

The washing machine of an embodiment has the auxiliary washing unit, and thus enables auxiliary washing.

Also, auxiliary washing can be performed independently from an existing washing method to improve washing efficiency.

Also, the auxiliary washing unit may be rotatably provided so that an operation of the auxiliary washing unit for auxiliary washing can be conveniently performed.

Also, the auxiliary washing unit may be detachably provided, and thus auxiliary washing can be selectively conveniently performed.

DETAILED DESCRIPTION

Hereinafter, exemplary embodiments will be described in detail with reference to the attached drawings.

Figure 1:
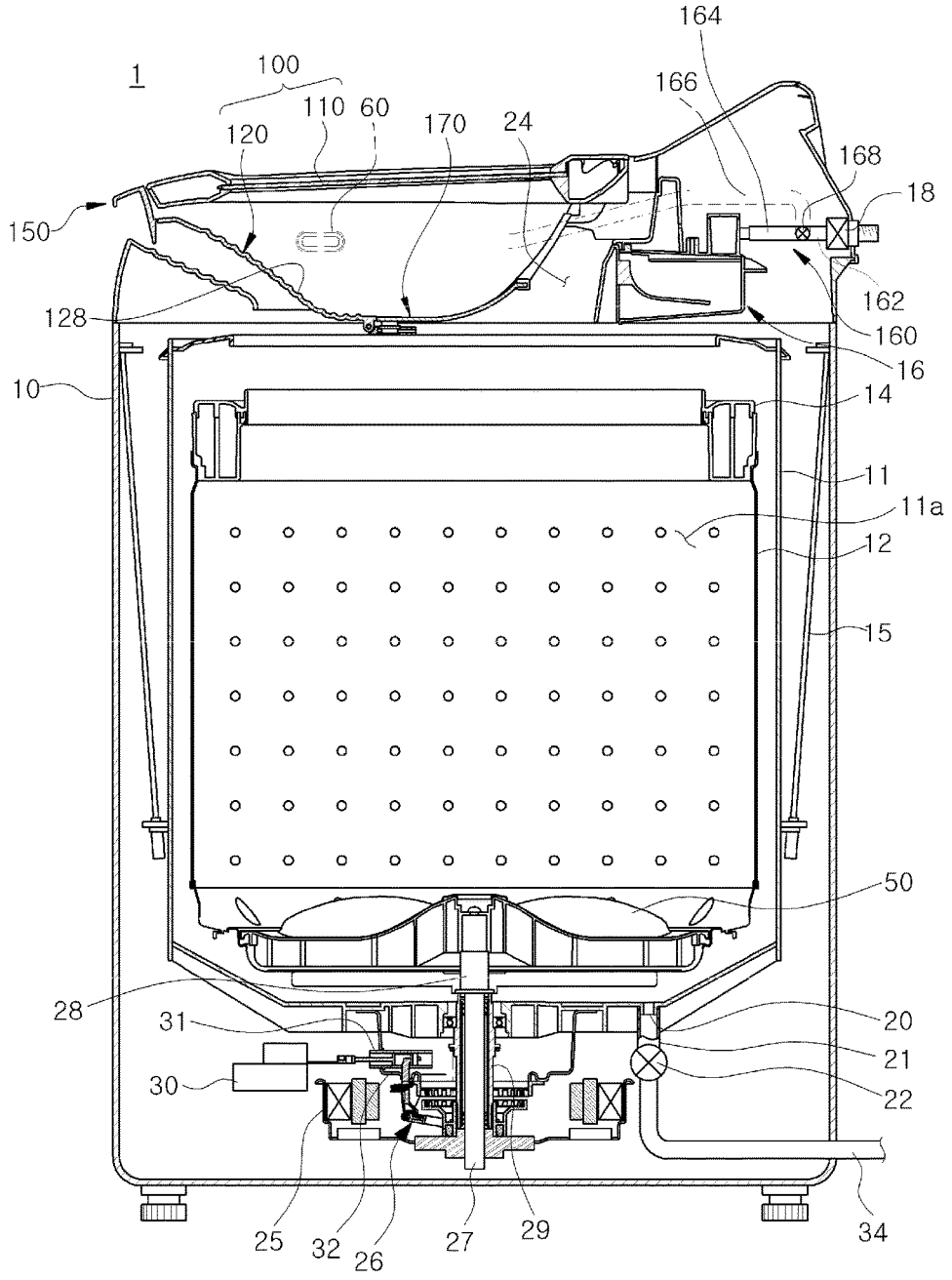
FIG. 1 is a cross-sectional view of a washing machine according to a first embodiment.

FIG. 1 is a cross-sectional view of a washing machine according to a first embodiment.

As illustrated in FIG. 1, a washing machine 1 includes, for example, a cabinet 10 that forms an exterior, a fixed tub 11 that is disposed in the cabinet 10 and in which washing water is stored, a rotating tub 12 that is rotatably disposed in the fixed tub 11, and a pulsator 50 that is disposed in the rotating tub 12 and generates a water current.

An opening 24 through which laundry may be put into the rotating tub 12 is formed in an upper portion of the cabinet 10. The opening 24 may be opened and closed by a door assembly 100 installed at the upper portion of the cabinet 10. The fixed tub 11 may be supported on the cabinet 10 by a suspension device 15.

A water supply pipe 162,164 for supplying washing water into the fixed tub 11 may be installed above the fixed tub 11. One side of the water supply pipe 162,164 may be connected to an external water supply source, and the other side of the water supply pipe 162,164 may be connected to a detergent supply device 16. Water supplied through the water supply pipe 162,164 may be supplied into the fixed tub 11 through the detergent supply device 16 together with detergent. A water supply valve 18 may be installed at the water supply pipe 162,164 to control water supply.

The rotating tub 12 may have a cylindrical shape with an opened upper portion, and a plurality of spin-drying holes 13 may be formed in sides of the rotating tub 12. A balancer 14 may be mounted on the upper portion of the rotating tub 12 so that the rotating tub 12 can rotate stably during high-speed rotation.

A motor 25 that generates a driving force to rotate the rotating tub 12 and the pulsator 50, and a power switching device 26 that simultaneously or selectively transfers the driving force generated by the motor 25 to the rotating tub 12 and the pulsator 50 are installed at a lower exterior of the fixed tub 11.

A hollow spin-drying shaft 29 may be coupled to the rotating tub 12, and a washing shaft 27 installed in a hollow portion of the spin-drying shaft 29 may be coupled to the pulsator 50 using a washing shaft coupling part 28. The motor 25 may simultaneously or selectively transfer the driving force to the rotating tub 12 and the pulsator 50 according to an ascending/descending operation of the power switching device 26.

The power switching device 26 may include an actuator 30 that generates a driving force for power switching, a rod part 31 that performs a linear motion according to an operation of the actuator 30, and a clutch part 32 that is connected to the rod part 31 to rotate according to an operation of the rod part 31.

A drain 20 may be formed in a bottom of the fixed tub 11 to discharge washing water stored in the fixed tub 11, and a first drain pipe 21 may be connected to the drain 20. A drain valve 22 may be installed in the first drain pipe 21 to control drainage. An outlet of the drain valve 22 may be connected to a second drain pipe 34 for discharging washing water to the outside.

Figure 2:
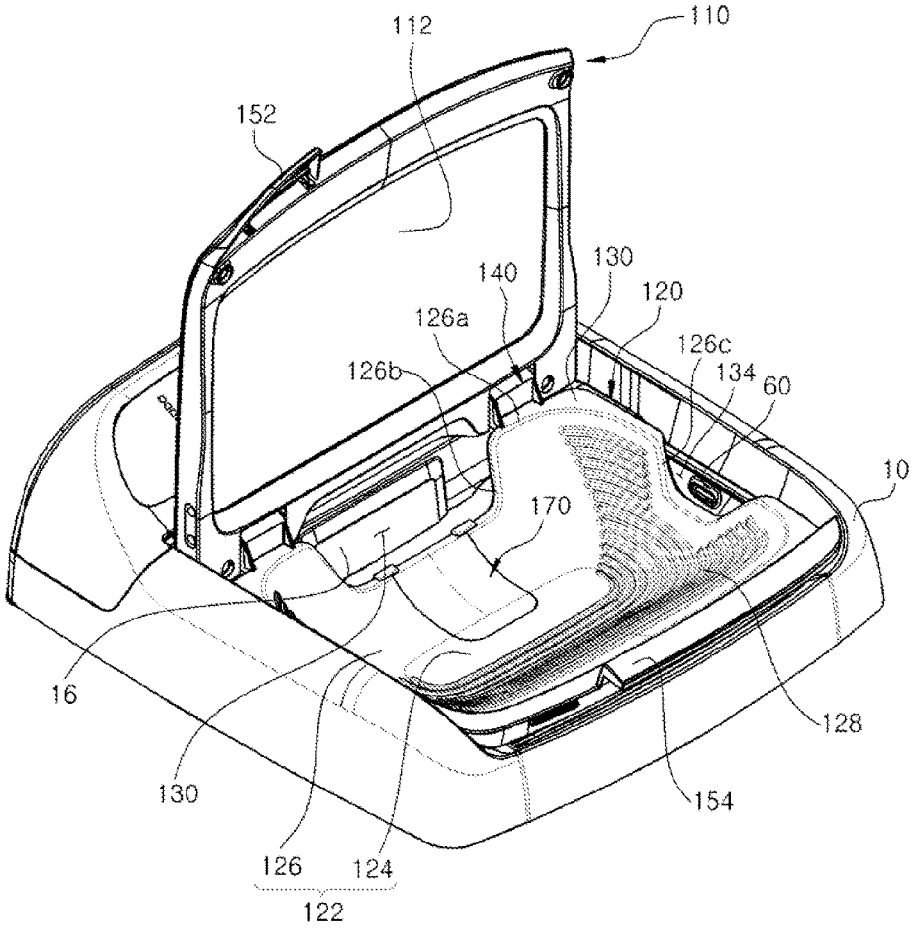
FIG. 2 is a perspective view of a state in which a door of the washing machine according to the first embodiment is opened.
Figure 3:
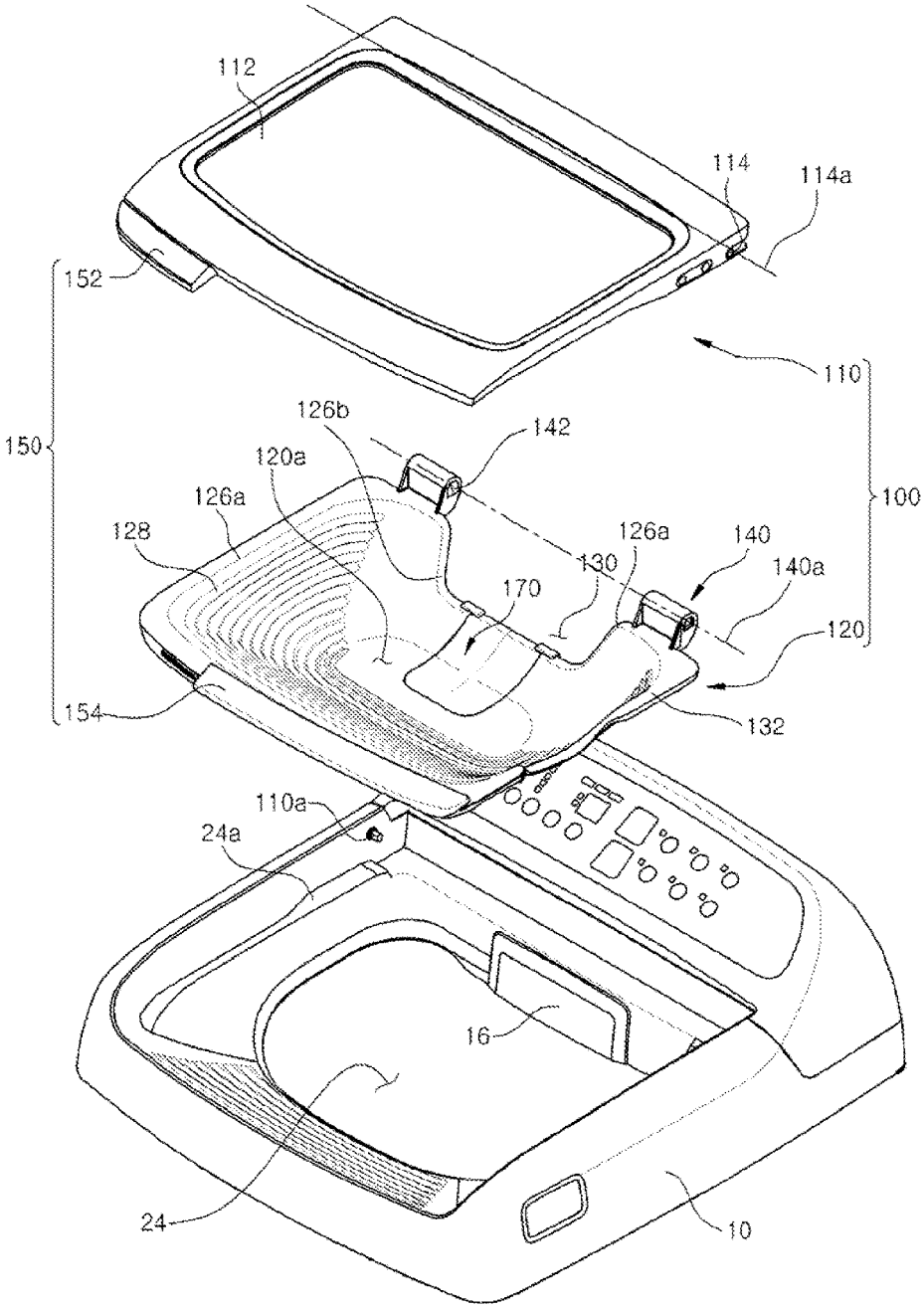
FIG. 3 is an exploded perspective view of a door assembly of the washing machine according to the first embodiment.
Figure 4:
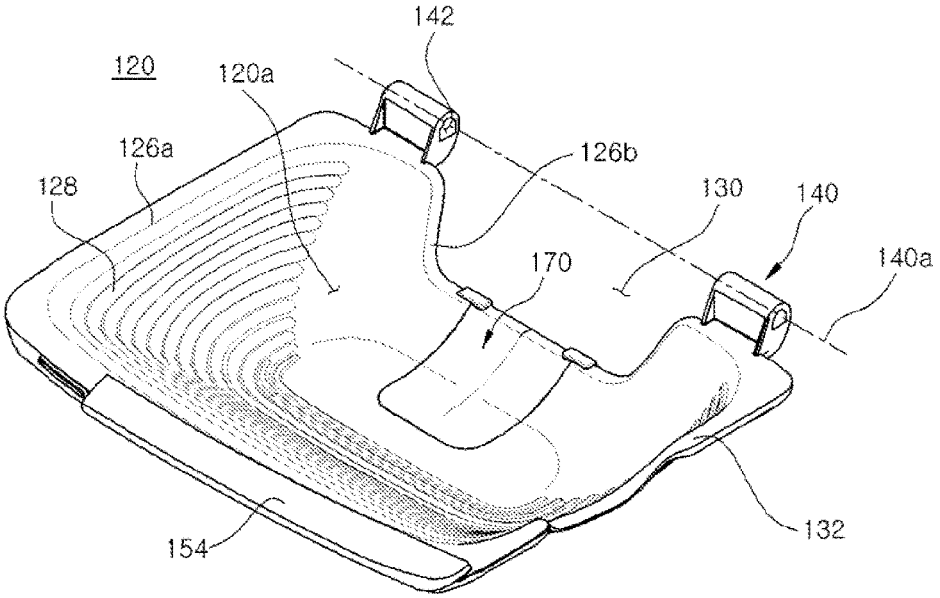
FIG. 4 is a perspective view of an auxiliary washing unit of the washing machine according to the first embodiment.

FIG. 2 is a perspective view of a state in which a door of the washing machine according to the first embodiment is opened, FIG. 3 is an exploded perspective view of a door assembly of the washing machine according to the first embodiment, and FIG. 4 is a perspective view of an auxiliary washing unit of the washing machine according to the first embodiment.

The door assembly 100 may be disposed in the opening 24.

The door assembly 100 may include a door 110 and an auxiliary washing unit 120.

The door 110 may be disposed at one side of the cabinet 10 to open and close the opening 24. A transparent member 112 may be disposed on the door 110 so that the inside of the washing machine 1 is visible even when the door 110 closes the opening 24.

The auxiliary washing unit 120 has an auxiliary washing space 120*a* in which hand-washing can be performed separately. The auxiliary washing space 120*a* may be provided so that washing can be performed separately from a main washing space 11*a* formed by the fixed tub and the rotating tub.

The main washing space 11*a* and the auxiliary washing space 120*a* are separated from each other so that washing can be performed independently in each space. Also, washing in the main washing space 11*a* and the auxiliary washing space 120*a* may be performed separately or simultaneously.

The auxiliary washing unit 120 may be disposed inside the door 110 to be rotatable about one side thereof. The auxiliary washing unit 120 may be disposed coaxially with a rotational axis of the door 110. Rotation of the auxiliary washing unit 120 and the door 110 will be described later in detail.

The auxiliary washing unit 120 may include a unit body 122 including a bottom part 124 and a side part 126.

The auxiliary washing space 120*a* of the auxiliary washing unit 120 may be formed by the unit body 122. The bottom part 124, which is a factor determining a depth of the auxiliary washing space 120*a*, may be provided to be flat or curved. The side part 126 may be formed to be inclined toward the bottom part 124.

The bottom part 124 and the side part 126 may be provided with the approximately concave auxiliary washing space 120*a* such that separate washing can be performed while washing water is received in the auxiliary washing space 120*a*.

The auxiliary washing unit 120 may include frictional protrusions 128.

The frictional protrusions 128 are provided on the unit body 122 to facilitate auxiliary washing. In an embodiment, the frictional protrusions 128 are provided on the side part 126. However, embodiments are not limited thereto. Any frictional protrusions 128 that are provided on an inner surface of the unit body 122 may be used. The frictional protrusions 128 serve to increase frictional force with the laundry when hand-washing is performed such that dirt is easily washed from the laundry. In an embodiment, the frictional protrusions 128 are formed to be more convex than an adjacent inner surface of the auxiliary washing unit 120. The plurality of frictional protrusions 128 may be formed in parallel, as in an embodiment. However, the shape and arrangement of the frictional protrusions 128 are not limited.

The auxiliary washing unit 120 may include an auxiliary drain 130.

The auxiliary drain 130 may be provided to drain the washing water used in the auxiliary washing space 120*a*. The auxiliary drain 130 may be provided in a hole shape, may have a separate opening and closing member, and may be disposed in the bottom part 124 of the auxiliary washing space 120*a*. In an embodiment, the auxiliary drain 130 may be disposed in the side part 126 of the unit body 122. The auxiliary drain 130 may be provided so that the washing water stored in the auxiliary washing space 120*a* may be tilted and discharged when the auxiliary washing unit 120 rotates.

The auxiliary drain 130 may be formed by an edge 126*b* of the auxiliary drain 130 formed to be lower than an adjacent upper end 126*a* of the unit body 122. That is, the auxiliary drain 130 may be formed in a portion that is recessed from the upper end 126*a* of the unit body 122. However, the shape of the auxiliary drain 130 is not limited, and any shape with which the auxiliary drain 130 can be disposed such that the washing water stored in the auxiliary washing space 120*a* can be discharged when the auxiliary washing unit 120 is tilted may be used.

The auxiliary washing unit 120 may include a seating flange 132.

The seating flange 132 may be formed in a flange shape on an upper end of the auxiliary washing unit 120 along an edge thereof and may be disposed to be seated on the cabinet 10. That is, the seating flange 132 may be provided in the flange shape along the upper end of the unit body 122.

A seating part 24*a* that protrudes along an edge of the opening 24 may be provided on an inner surface of the opening 24 of the cabinet 10. The seating flange 132 may be provided to be seated on the seating part 24*a*. The seating flange 132 may be seated on the seating part 24*a* so that the auxiliary washing unit 120 can be fixed to the cabinet 10.

A water supply device 160 for supplying water into the main washing space 11*a* and the auxiliary washing space 120*a* may be included.

The water supply device 160 may include a water supply pipe 162, a main water supply pipe 164, an auxiliary water supply pipe 166 and a switching unit 168. One end of the water supply pipe 162 may be connected to the water supply valve 18, and the other end thereof may be connected to the switching unit 168. The water supply pipe 162 may be provided to transfer the washing water supplied from the water supply valve 18 to the switching unit 168.

The main water supply pipe 164 may be provided to supply water into the main washing space 11*a*. One end of the main water supply pipe 164 may be connected to the detergent supply device 16, and the other end thereof may be connected to the switching unit 168.

The auxiliary water supply pipe 166 may be provided to supply water into the auxiliary washing space 120*a* of the auxiliary washing unit 120. One end of the auxiliary water supply pipe 166 may be connected to an auxiliary water supply port 60, and the other end thereof may be connected to the switching unit 168.

The switching unit 168 may be provided to selectively supply the washing water transferred from the water supply pipe 162 to one of the main water supply pipe 164 and the auxiliary water supply pipe 166. That is, the switching unit 168 may be provided so that the washing water can be supplied into a washing space through at least one of the main water supply pipe 164 and the auxiliary water supply pipe 166 through control of the switching unit 168. The switching unit 168 may include a three-way valve.

In an embodiment, the main water supply pipe 164 and the auxiliary water supply pipe 166 are provided to branch off from the water supply pipe 162 with the switching unit 168 interposed therebetween. Alternatively, the main water supply pipe 164 and the auxiliary water supply pipe 166 may be connected to the water supply valve 18 so that the washing water can be supplied by controlling the water supply valve 18. That is, the other end of the main water supply pipe 164 having the one end connected to the detergent supply device 16, and the other end of the auxiliary water supply pipe 166 having the one end connected to the auxiliary water supply port 60 may be connected to the water supply valve 18.

Also, in an embodiment, the washing water may be selectively supplied to one of the main water supply pipe 164 and the auxiliary water supply pipe 166. However, the washing water may be simultaneously supplied to the main water supply pipe 164 and the auxiliary water supply pipe 166.

The auxiliary water supply port 60 may be disposed in communication with the auxiliary water supply pipe 166. The auxiliary water supply port 60 may be disposed at one side of the auxiliary washing unit 120 to supply the washing water into the auxiliary washing unit 120.

The auxiliary washing unit 120 may include a washing water inlet 134 corresponding to the auxiliary water supply port 60, so that the washing water supplied from the auxiliary water supply port 60 can be introduced into the auxiliary washing unit 120. The washing water inlet 134 may be formed by an inlet edge 126*c* formed to be lower than the adjacent upper end 126*a* of the unit body 122. That is, the washing water inlet 134 may be formed in a portion that is recessed from the upper end of the unit body 122. However, the shape of the washing water inlet 134 is not limited, and any shape that is not interfered with by the unit body 122 when the washing water is introduced through the auxiliary water supply port 60 so that the washing water can be introduced into the auxiliary washing space 120*a* may be used.

The auxiliary washing unit 120 may be formed of a thermoplastic resin. The auxiliary washing unit 120 may be formed of an ABS material. However, embodiments are not limited thereto, and the auxiliary washing unit 120 may be formed of any material having sufficient shock resistance and rigidity for hand-washing.

Figure 5:
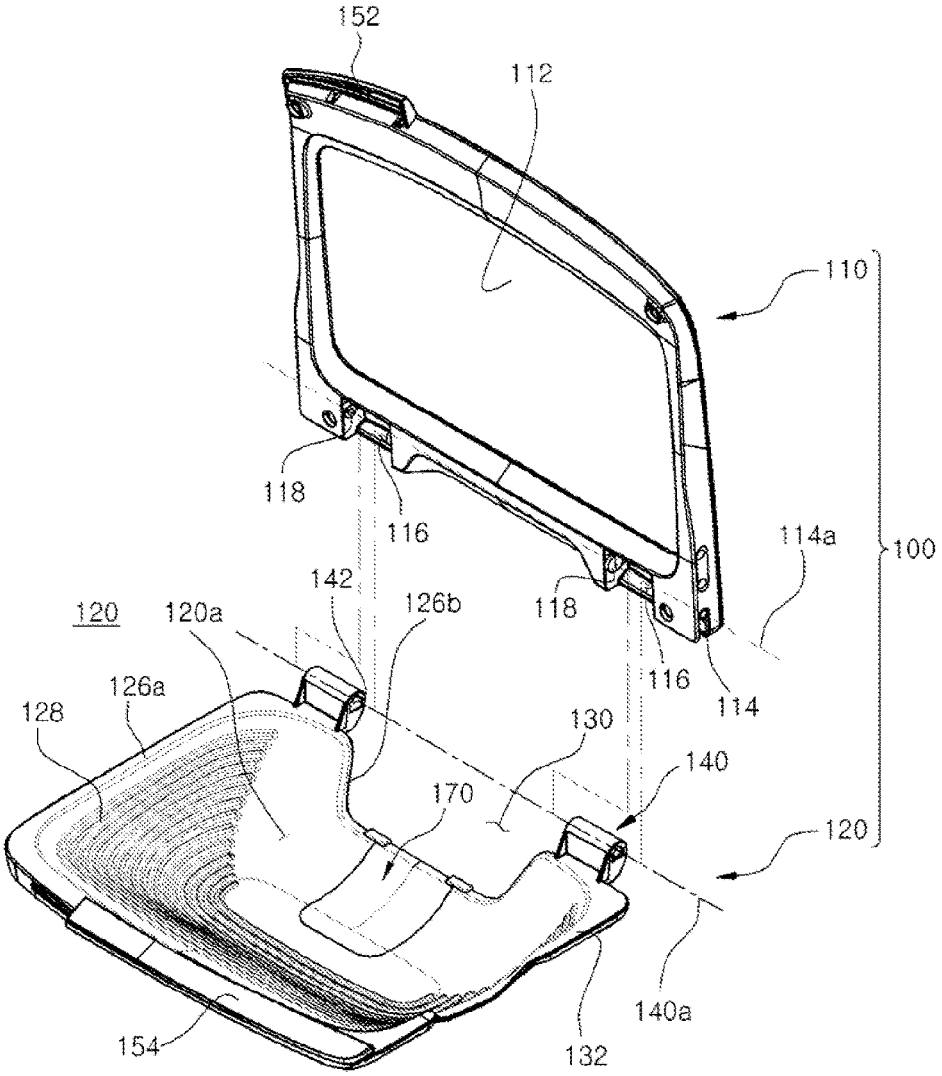
FIG. 5 is a perspective view of coupling of the auxiliary assembly of the washing machine according to the first embodiment.
Figure 6:
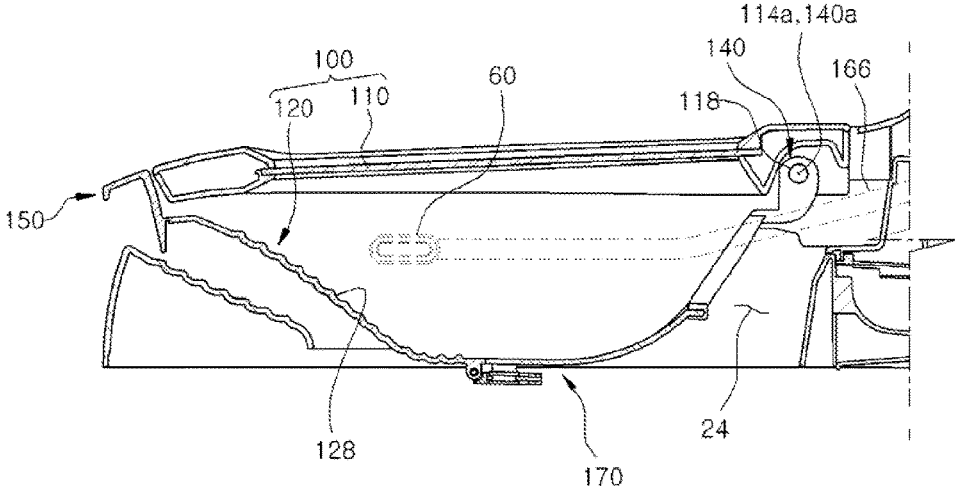
FIG. 6 is a cross-sectional view of the door assembly of the washing machine according to the first embodiment.
Figure 7:
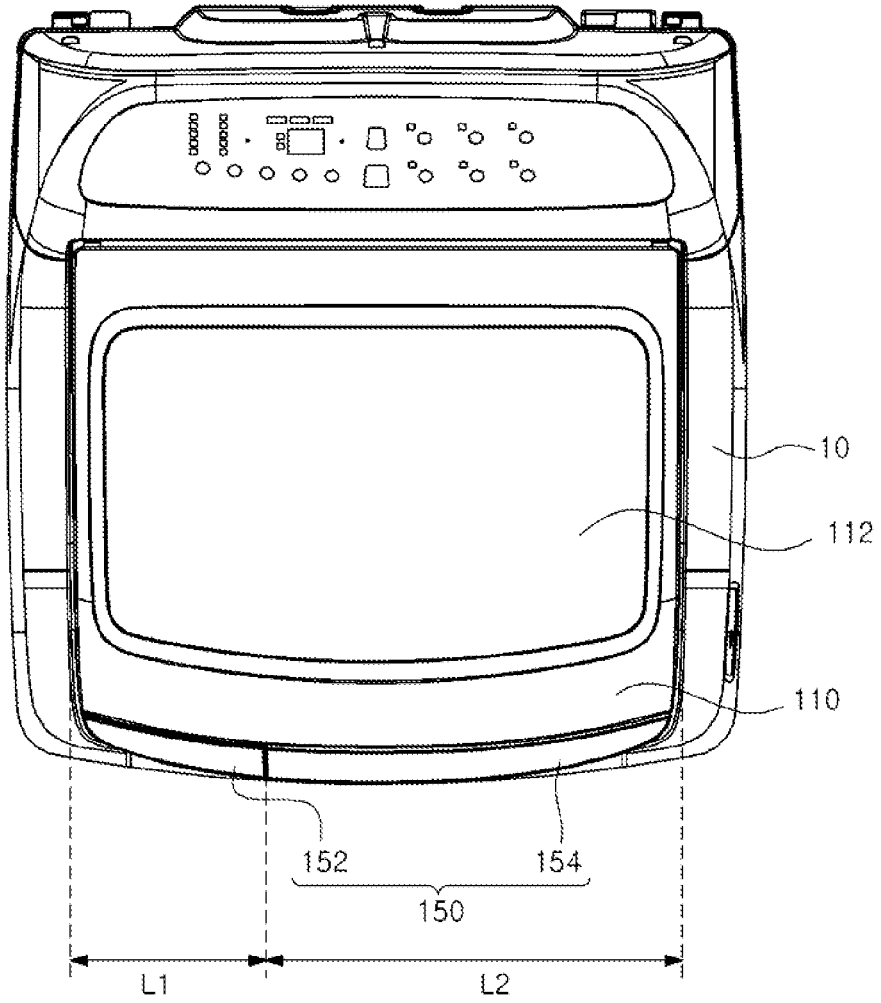
FIG. 7 is a top view of the washing machine according to the first embodiment.

FIG. 5 is a perspective view of coupling of an door assembly of the washing machine according to the first embodiment, FIG. 6 is a cross-sectional view of a door assembly of the washing machine according to the first embodiment, and FIG. 7 is a top view of the washing machine according to the first embodiment.

The door 110 and the auxiliary washing unit 120 may each be provided to be rotatable with respect to the cabinet 10.

The door 110 may be provided to be rotatable about a door rotation axis 114*a*, and the auxiliary washing unit 120 may be provided to be rotatable about an auxiliary rotation axis 140*a*.

In an embodiment, the door rotation axis 114*a* and the auxiliary rotation axis 140*a* are disposed on the same side of the door 110 and the auxiliary washing unit 120 to be opened and closed in the same direction.

The door rotation axis 114*a* and the auxiliary rotation axis 140*a* may be coaxial. That is, the door rotation axis 114*a* and the auxiliary rotation axis 140*a* may be coincident.

To this end, the door 110 may be rotatably coupled to the cabinet 10 by a door rotation part 110*a* disposed on the cabinet 10 along the door rotation axis 114*a*, and the auxiliary washing unit 120 may be rotatably coupled to the door 110 by an auxiliary rotation part 140.

The door rotation part 110*a* may be formed in a shape that protrudes toward the door rotation axis 114*a* so that the door 110 can rotate about the door rotation axis 114*a* on the cabinet 10. Specifically, an accommodation part 114 may be disposed in the door 110, and the door rotation part 110*a* may be inserted into the accommodation part 114 so that the door 110 is rotatably supported by the cabinet 10. However, embodiments are not limited thereto, and the door rotation part 110*a* may be formed in a shape that protrudes toward the door rotation axis 114*a* so that the door 110 can rotate about the door rotation axis 114*a* on an outer surface of the door 110. The shape of the door rotation part 110*a* is not limited, and any shape with which the door 110 is rotatable with respect to the cabinet 10 may be used.

The door 110 may include an insertion part 116 formed to be recessed from one side of the door 110 so that the auxiliary rotation part 140 can rotate, and rotation protrusions 118 may be formed on the insertion part 116 to protrude toward the auxiliary rotation axis 140*a* so that the auxiliary washing unit 120 can rotate about the auxiliary rotation axis 140*a*. Rotation holes 142 corresponding to the rotation protrusions 118 may be formed in the auxiliary washing unit 120. The auxiliary rotation part 140 may be rotatably inserted into a part of the door 110 so that the door rotation axis 114*a* and the auxiliary rotation axis 140*a* coincide.

However, the shape and arrangement in which the door 110 and the auxiliary washing unit 120 rotate are not limited. Any shape or arrangement in which the door 110 and the auxiliary washing unit 120 are configured to open and close the opening 24 may be used.

The auxiliary rotation part 140 may be provided to protrude from the unit body 122 so that the auxiliary rotation axis 140*a* is spaced apart from the unit body 122. Through this configuration, a rotational radius of the auxiliary washing unit 120 may be increased, and the unit body 122 may also be prevented from interfering with the door 110 or the cabinet 10 when the auxiliary washing unit 120 rotates.

The door assembly 100 may include a handle part 150.

The handle part 150 may include a door handle part 152 provided at the door 110, and an auxiliary handle part 154 provided at the auxiliary washing unit 120.

The door handle part 152 may be disposed at the other side of the door 110 to correspond to the door rotation axis 114*a* disposed at one side thereof. In the same manner, the auxiliary handle part 154 may be disposed at the other side of the auxiliary washing unit 120 to correspond to the auxiliary rotation axis 140*a* disposed at one side thereof. The door handle part 152 and the auxiliary handle part 154 may be provided in parallel in a lengthwise direction.

The door handle part 152 and the auxiliary handle part 154 may be provided on a front surface of the door 110 and a front surface of the auxiliary washing unit 120, respectively, so that the door 110 and the auxiliary washing unit 120 can be rotated. The door 110 may be rotated through an operation of the door handle part 152, and only the auxiliary washing unit 120 may be rotated or the auxiliary washing unit 120 and the door 110 may be rotated together through an operation of the auxiliary handle part 154.

On a front surface of the door assembly 100, the door handle part 152 may be formed to have a first length L1, and the auxiliary handle part 154 may be formed to have a second length L2 in parallel with the first length L1. When the door handle part 152 is operated, the door 110 may rotate, and when the auxiliary handle part 154 is operated while the door 110 is opened, the auxiliary washing unit 120 may be rotated. When the auxiliary handle part 154 is operated while the door 110 is closed, the door 110 and the auxiliary washing unit 120 may be rotated together, and thus the second length L2 may be longer than the first length L1 in consideration of weights of the door 110 and the auxiliary washing unit 120. That is, the auxiliary handle part 154 may be formed longer than the door handle part 152.

Hereinafter, an operation of the door assembly 100 of the washing machine 1 having the above configuration will be described.

Figure 8A:
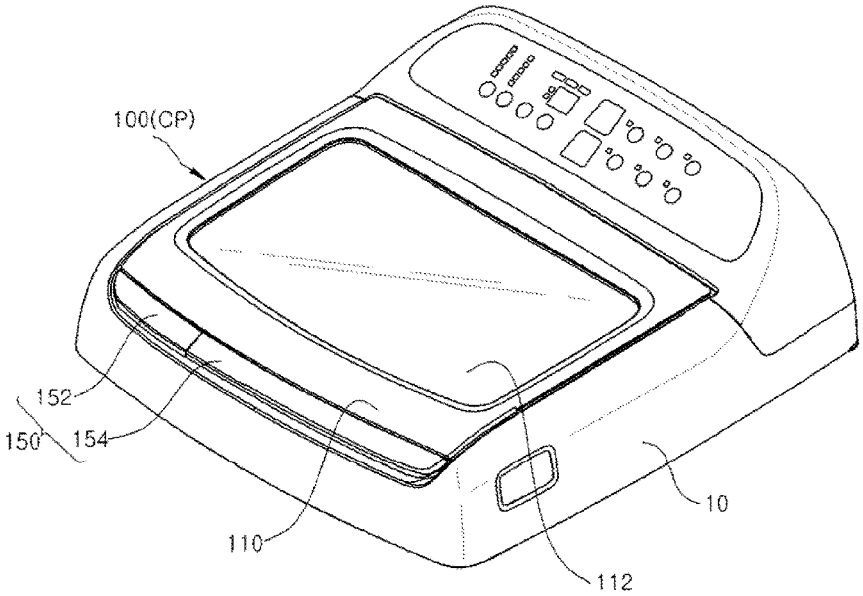
FIGS. 8A, 8B and 8C illustrate an operation of the door assembly of the washing machine according to the first embodiment.
Figure 8B:
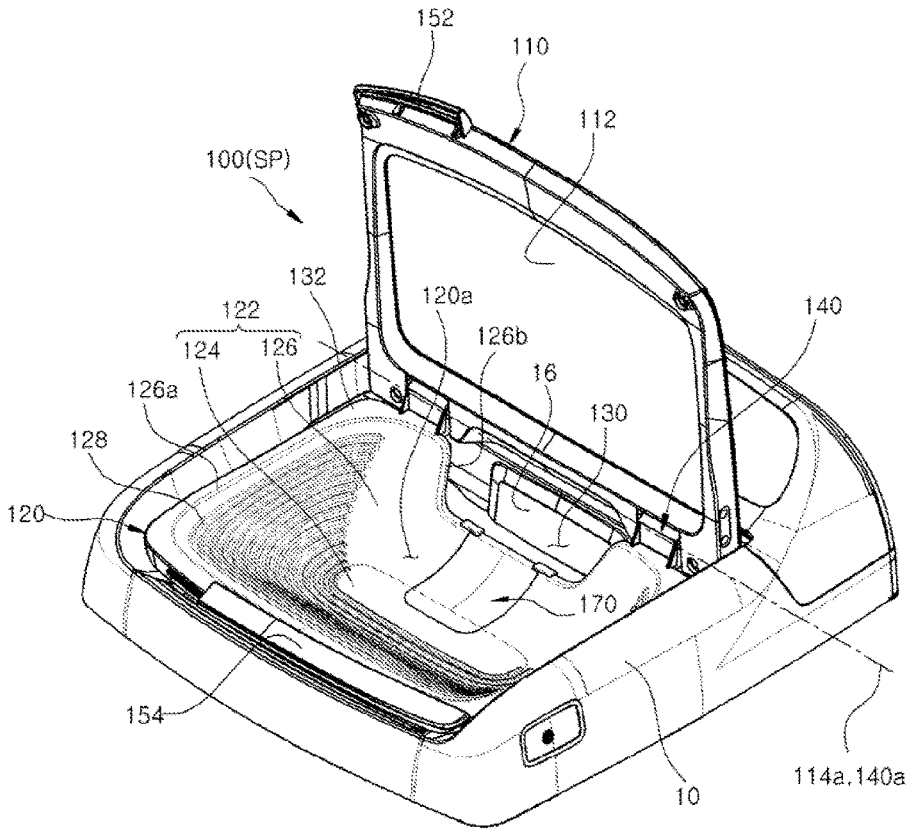
Figure 8C:
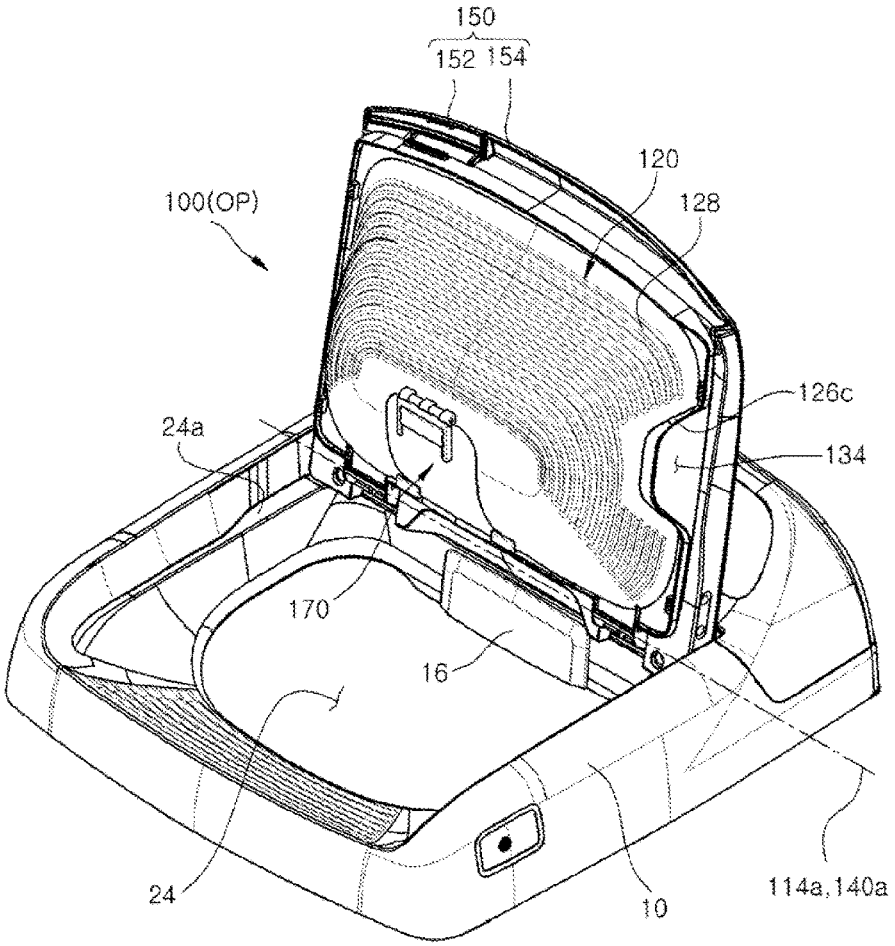

FIGS. 8A, 8B and 8C illustrate an operation of the door assembly of the washing machine according to the first embodiment.

The door assembly 100 may be provided to be capable of rotating to a closed position CP, an auxiliary washing position SP and an opened position OP. The closed position CP is a position in which the door 110 and the auxiliary washing unit 120 are disposed in the opening 24 so that the door assembly 100 closes the opening 24. The auxiliary washing position SP is a position in which the door assembly 100 is disposed such that the door 110 rotates from the closed position CP and auxiliary washing may be performed in the auxiliary washing unit 120. The opened position OP is a position in which the door 110 and the auxiliary washing unit 120 rotate from the closed position CP or the auxiliary washing position SP so that the door assembly 100 opens the opening 24.

The door assembly 100 may be moved to the closed position CP and the auxiliary washing position SP through the operation of the door handle part 152, and the door assembly 100 may be moved to the closed position CP and the opened position OP through the operation of the auxiliary handle part 154.

Hereinafter, an operation of the auxiliary washing unit 120 of the washing machine 1 having the above configuration will be described.

Figure 9A:
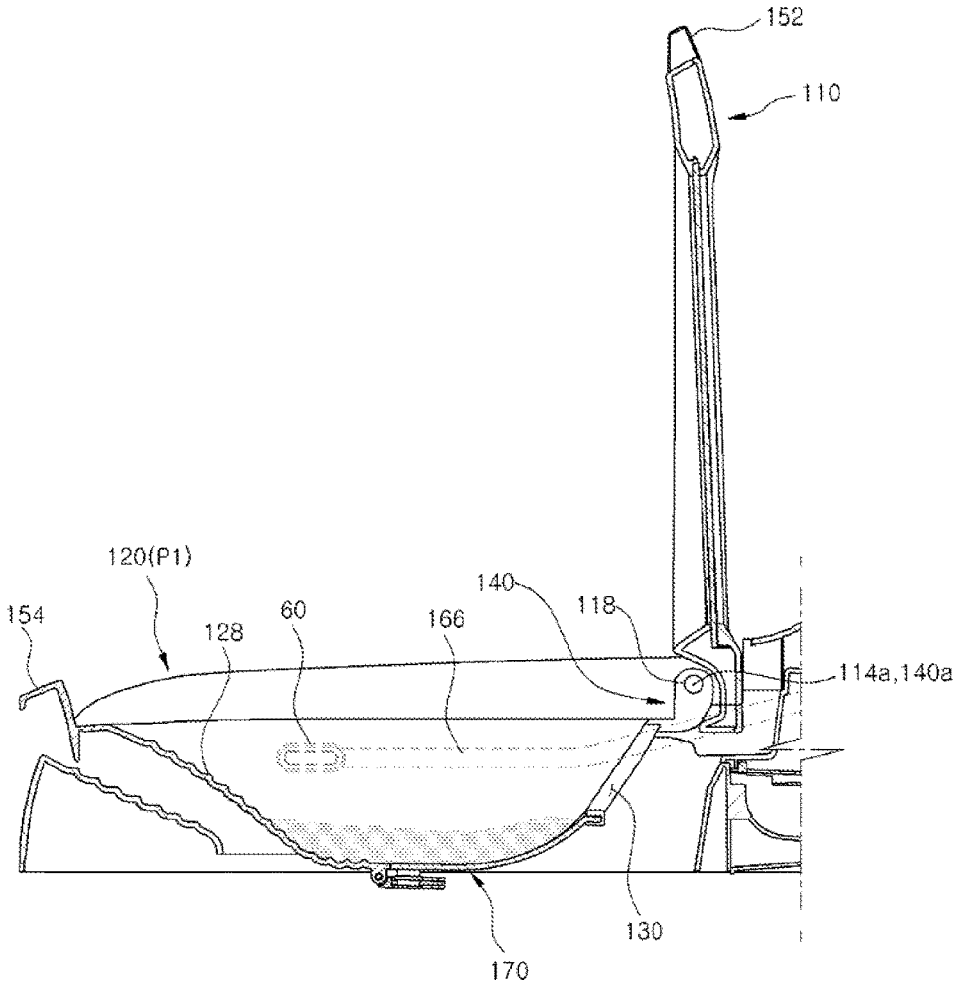
FIGS. 9A and 9B illustrate an operation of the auxiliary washing unit of the washing machine according to the first embodiment.
Figure 9B:
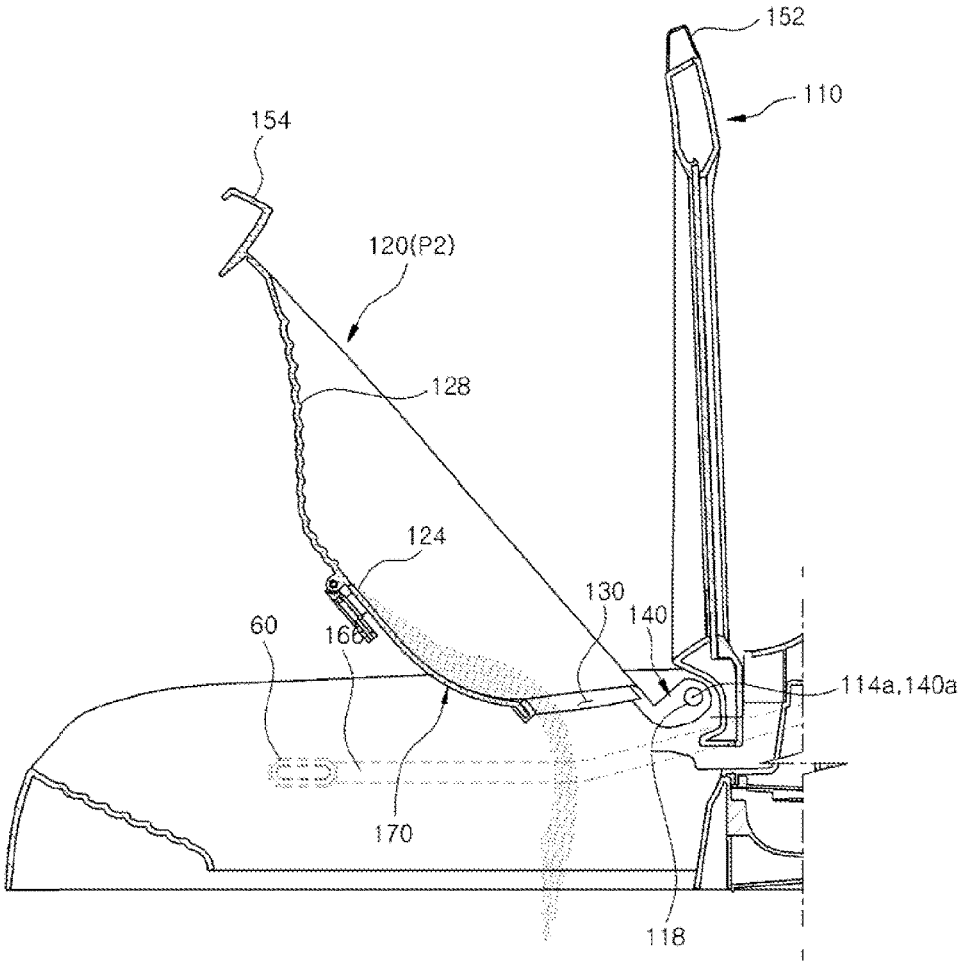

FIGS. 9A and 9B illustrate an operation of the auxiliary washing unit of the washing machine according to the first embodiment.

After the door assembly 100 finishes auxiliary washing in the auxiliary washing position SP, the washing water may be discharged into the main washing space 11*a* or to an outside of the washing machine 1 through the auxiliary drain 130.

Specifically, if a position of the auxiliary washing unit 120 is called a first position P1 when the door assembly 100 is in the auxiliary washing position SP, the auxiliary washing unit 120 may be provided to rotate between the first position P1 and a second position P2 in which the auxiliary washing unit 120 rotates from the first position P1 so that the washing water in the auxiliary washing space 120*a* is discharged into the main washing space 11*a* or to the outside of the washing machine 1 through the auxiliary drain 130. The second position P2 is a position in which the auxiliary washing unit 120 rotates about the auxiliary rotation axis 140*a* and is tilted so that the washing water in the auxiliary washing space 120*a* is discharged through the auxiliary drain 130. The second position P2 may be formed between the first position P1 and a position of the auxiliary washing unit 120 when the door assembly 100 is in the opened position OP.

Since the auxiliary drain 130 may be formed in a portion having a lower height than the adjacent side part 126, the washing water may be smoothly discharged through the auxiliary drain 130 even when the auxiliary washing unit 120 is tilted so that the washing water does not overflow from the upper end of the side part 126.

Figure 10:
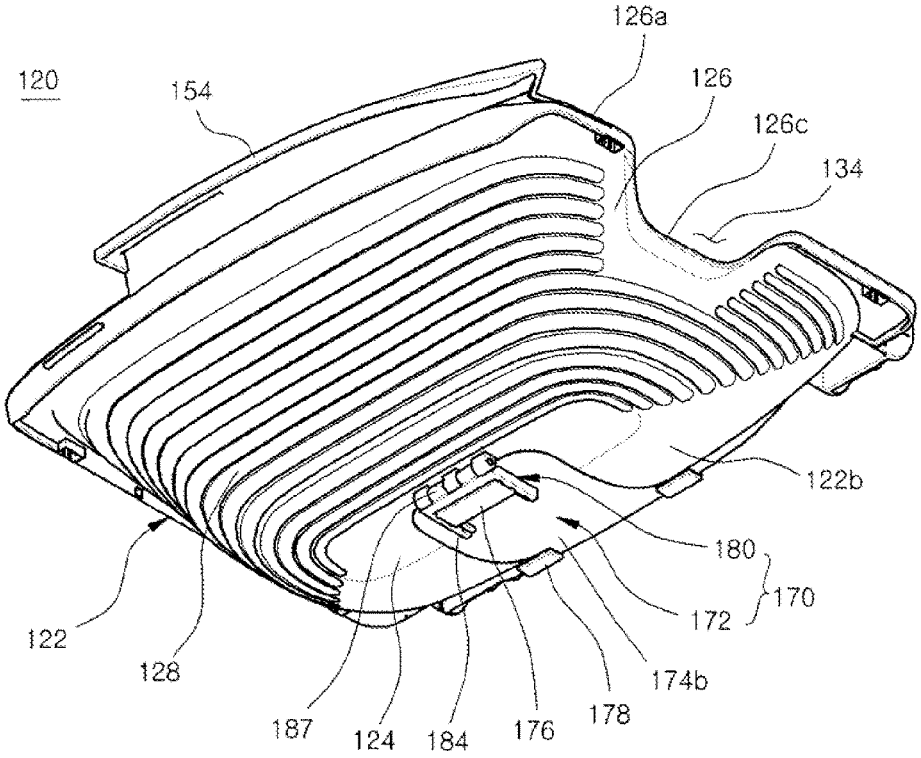
FIG. 10 is a lower perspective view of the auxiliary washing unit according to the first embodiment.
Figure 11:
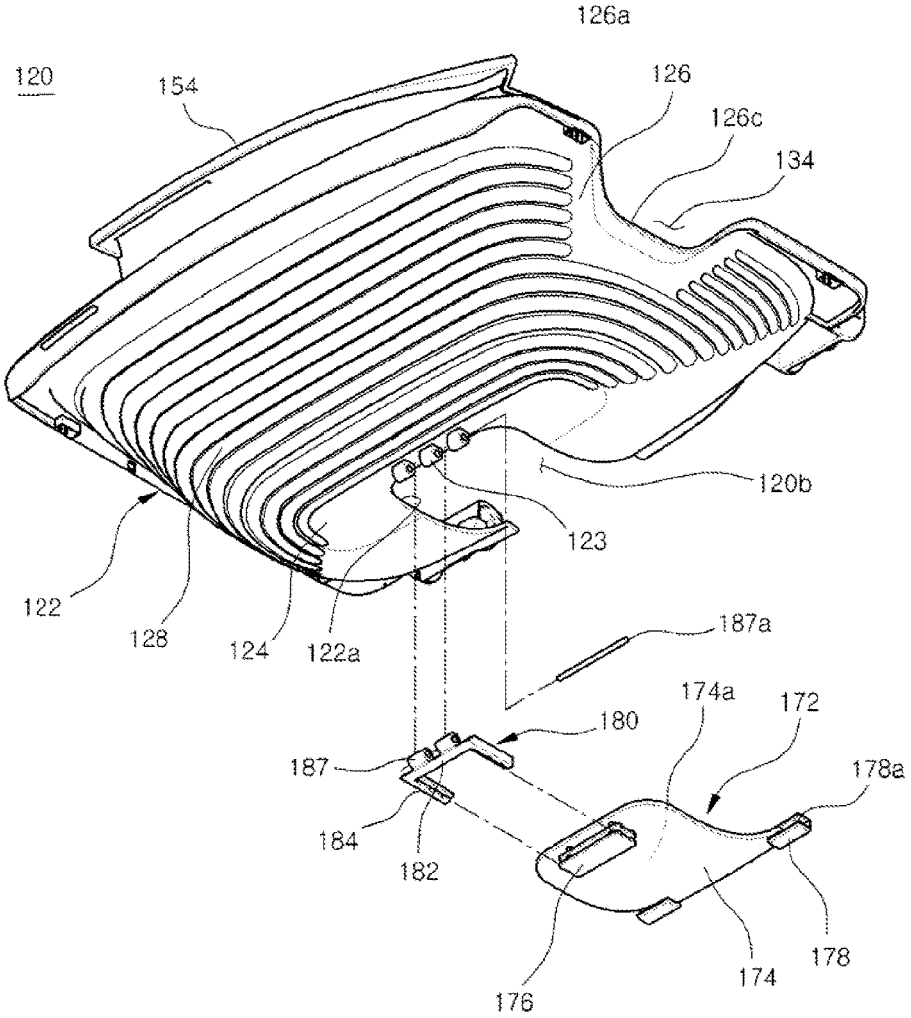
FIG. 11 is an exploded perspective view of the auxiliary washing unit according to the first embodiment.

FIG. 10 is a lower perspective view of the auxiliary washing unit according to the first embodiment, and FIG. 11 is an exploded perspective view of the auxiliary washing unit according to the first embodiment.

The auxiliary washing unit 120 may include a discharging assembly 170.

The auxiliary washing unit 120 may have a discharging hole 120*b* through which the laundry or the washing water is discharged from the auxiliary washing space 120*a* to the main washing space 11*a*. The discharging assembly 170 may be provided to open and close the discharging hole 120*b*, such that the laundry or the washing water in the auxiliary washing space 120*a* is selectively discharged to the main washing space 11*a*. The discharging hole 120*b* may be formed to pass through the auxiliary washing space 120*a*.

As described above, the unit body 122 may be formed to include the bottom part 124 and the side part 126. At least a part of the discharging hole 120*b* may be formed at the bottom part 124. That is, the discharging hole 120*b* may be formed from the bottom part 124, and thus when the laundry or the washing water may be discharged to the main washing space 11*a* through the discharging assembly 170, the laundry or the washing water in the auxiliary washing space 120*a* may be completely and easily discharged.

The discharging hole 120*b* may be formed from the bottom part 124 to the upper end 126*a* of the unit body 122. Since the discharging hole 120*b* may be formed from the bottom part 124 to the upper end 126*a* of the unit body 122, the laundry or the washing water in the auxiliary washing space 120*a* to be described later may be easily discharged to the main washing space 11*a*. In the embodiment, the discharging hole 120*b* may be formed to extend to the upper end 126*a* of the unit body 122, and may be provided to extend to the edge 126*b* of the auxiliary drain 130 which defines the auxiliary drain 130.

Through such a structure, an operation in which the laundry or the washing water in the auxiliary washing space 120*a* is separately taken out and then put into the main washing space 11*a* may be omitted. However, a size of the discharging hole 120*b* is not limited, and the discharging hole 120*b* may be formed within the unit body 122, instead of being formed to an end of the unit body 122, like a discharging hole 120*b* according to a second embodiment.

The discharging hole 120*b* may be provided to be selectively opened and closed by the discharging assembly 170 and thus to expand an area of the auxiliary drain 130. That is, the discharging hole 120*b* may be provided to be connected to the auxiliary drain 130. In other words, the auxiliary drain 130 may be formed to extend from the discharging hole 120*b*.

When the door assembly 100 is at the auxiliary washing position SP, the auxiliary washing unit 120 may rotate to the first position P1 and the second position P2 so that the washing water in the auxiliary washing space 120*a* is discharged to the main washing space 11*a* or the outside of the washing machine. The discharging hole 120*b* may be formed so that a width or an area of the auxiliary drain 130 is expanded, and thus the laundry or the washing water in the auxiliary washing space 120*a* may be discharged to the main washing space 11*a*, even when the auxiliary washing unit 120 does not rotate to the first position P1 and the second position P2.

Figure 12A:
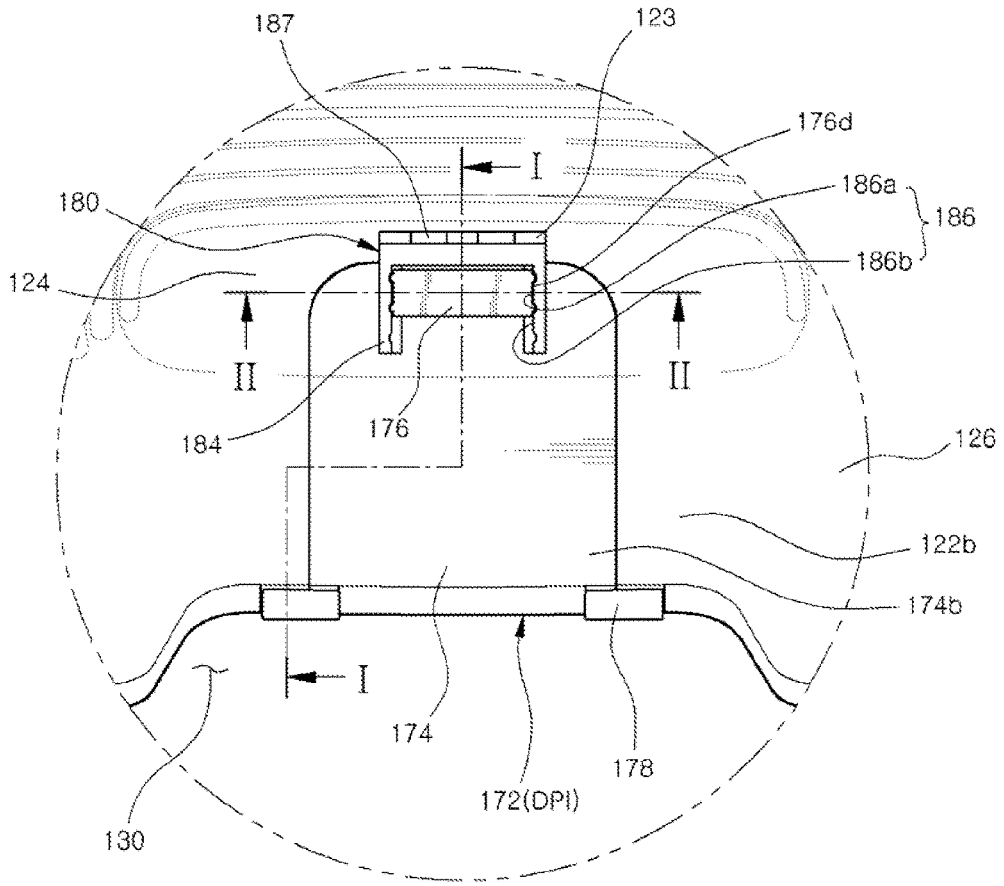
FIGS. 12A and 12B are lower front views of the auxiliary washing unit according to the first embodiment.
Figure 12B:
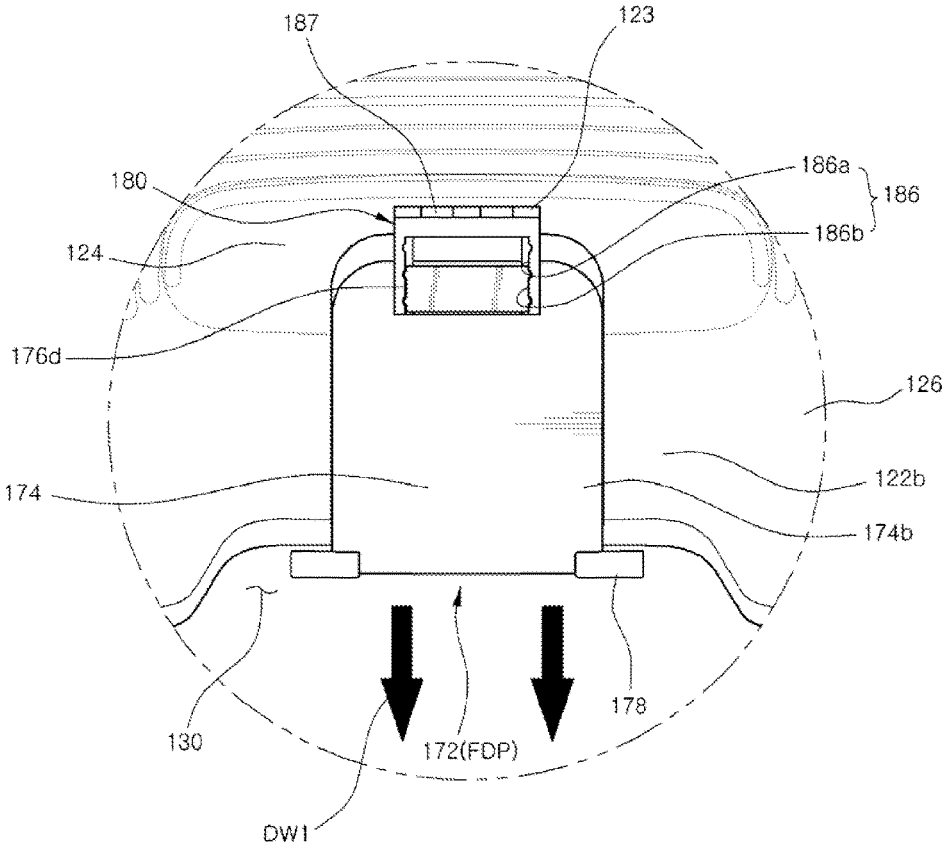
Figure 13A:
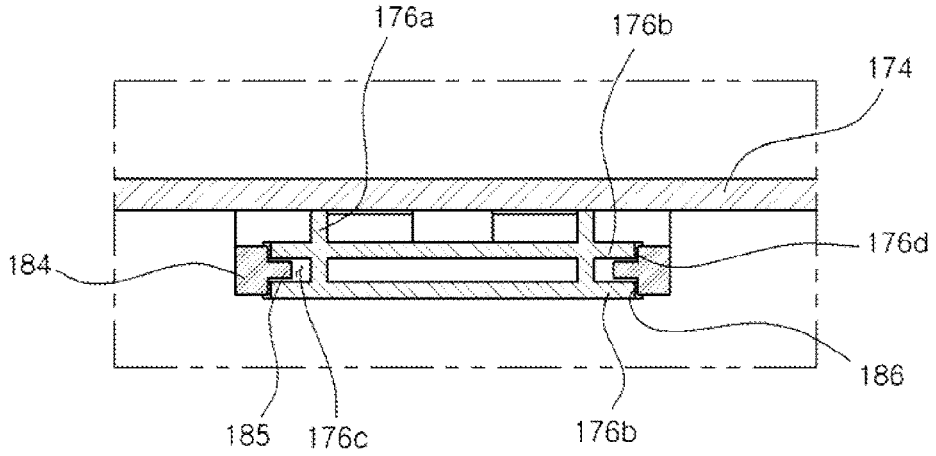
FIG. 13A is a cross-sectional view taken along line I-I of FIG. 12A.
Figure 13B:
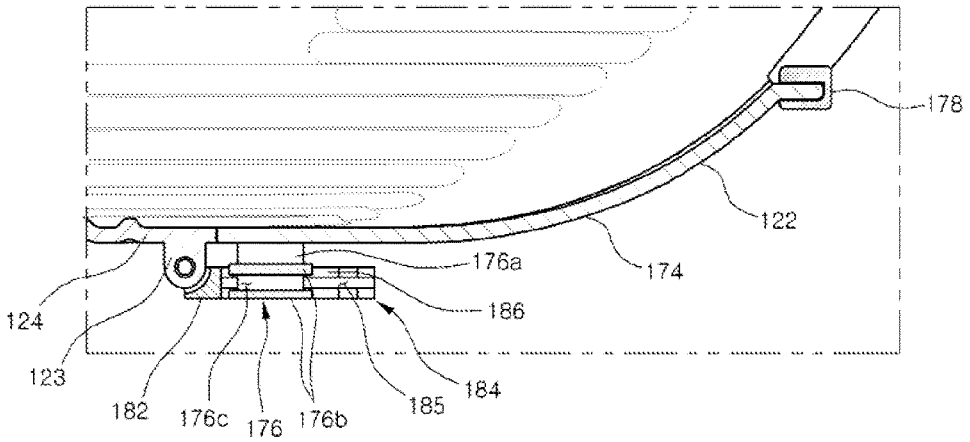
FIG. 13B is a cross-sectional view taken along line II-II of FIG. 12A.

FIGS. 12A and 12B are lower front views of the auxiliary washing unit according to the first embodiment, FIG. 13A is a cross-sectional view taken along line I-I of FIG. 12A, and FIG. 13B is a cross-sectional view taken along line II-II of FIG. 12A.

The discharging assembly 170 may be provided to open and close the discharging hole 120*b*.

The discharging assembly 170 may include a discharging door 172, and a door holder 180 which guides an operation of the discharging door 172.

The discharging door 172 may be provided to open and close the discharging hole 120*b*. A shape of the discharging door 172 is not limited, and may be provided to coincide with the discharging hole 120*b*, such that the auxiliary washing space 120*a* is formed at an inner side of the auxiliary washing unit 120 when the discharging hole 120*b* is closed.

The discharging door 172 may be provided so that a surface area of the discharging hole 120*b* is varied. That is, the discharging door 172 may be operated between a state in which the surface area of the discharging hole 120*b* is minimum and a state in which the surface area thereof is maximum. From a different prospective, the discharging door 172 may be provided to open and close the discharging hole 120*b*. The state in which the surface area of the discharging hole 120*b* is minimum is a state in which the discharging hole 120*b* is closed by the discharging door 172, and the state in which the surface area of the discharging hole 120*b* is maximum is a state in which the discharging hole 120*b* is opened by the discharging door 172.

The discharging door 172 may be provided to be injection-molded with the unit body 122 and then to be separated. That is, the discharging door 172 may be formed of the same material as the unit body 122.

Also, through such a structure, when the surface area of the discharging hole 120*b* is minimum, a door inner surface 174*a* which is an inner surface of the discharging door 172 may be a surface extending from an inner surface 122*a* of the unit body 122 which forms the auxiliary washing space 120*a*. When the surface area of the discharging hole 120*b* is minimum, the discharging hole 120*b* is closed by the discharging door 172, and thus the door inner surface 174*a* of the discharging door 172 and the inner surface 122*a* of the unit body 122 coincide with each other.

Specifically, the door inner surface 174*a* and a door outer surface 174*b* which are the inner surface and an outer surface of the discharging door 172 may be the surface extending from the inner surface 122*a* of the unit body 122 which forms the auxiliary washing space 120*a*, and a surface extending from an outer surface 122*b* of the unit body 122 which is an opposite surface to the inner surface 122*a*, respectively. Since the discharging door 172 may be formed with the unit body 122 and then separated by a cutting process or the like, the discharging door 172 and the unit body 122 may be provided with no step therebetween.

The discharging door 172 may be provided to be moved between a first position DP1 in which the discharging hole 120*b* is closed and a second position DP2 in which the discharging hole 120*b* is opened. When the discharging door 172 is at the first position DP1, the discharging door 172 is fixed to the unit body 122, and when the discharging door 172 is at the second position DP2, the discharging door 172 is released from the unit body 122 so as to open the discharging hole 120*b*. That is, the discharging door 172 may further include a releasing position FDP in which the discharging door 172 is released from the unit body 122 between the first position DP1 and the second position DP2, when moved from the first position DP1 to the second position DP2.

In the embodiment, a moving direction of the discharging door 172 between the first position DP1 and the releasing position FDP is a forward and backward direction of the washing machine 1. Here, the moving direction is defined as a first direction DW1, and an up and down direction of the washing machine 1 vertical to the moving direction is defined as a second direction DW2.

The discharging door 172 may include a door body 174, a slider 176 and a restriction member 178.

The door body 174 may be provided to correspond to the discharging hole 120*b* and thus to close the discharging hole 120*b* when the discharging door 172 is at the first position DP1.

The slider 176 may be provided at one end of the door body 174 to be coupled to the door holder 180. The slider 176 may be moved along a sliding rail 184 of the door holder 180, which will be described later. The slider 176 may be integrally formed with the door body 174, and may be provided to be moved along the sliding rail 184, such that the discharging door 172 is moved between the first position DP1 and the releasing position FDP.

The slider 176 may include a slider body 176*a* which is formed to extend from the door body 174, a rail restricting part 176*b* which is formed on the slider body 176*a* to have a flange shape in parallel with the unit body 122, and one pair of coupling grooves 176*d* which are formed at both sides of the rail restricting part 176*b*.

One pair of rail restricting parts 176*b* may be provided at the slider body 176*a* to be spaced apart from each other, and a guide space 176*c* in which a movement guide part 185 of the sliding rail 184 is inserted may be formed between the pair of rail restricting parts 176*b*.

The pair of coupling grooves 176*d* may be selectively coupled to a first coupling part 186*a* or a second coupling part 186*b* of the sliding rail 184, which will be described later, through a movement of the slider 176.

The restriction member 178 may be provided so that an end of the discharging door 172 is selectively fixed to the unit body 122. The restriction member 178 may be provided at the other end of the door body 174 so that the other end of the door body 174 is selectively restricted by the unit body 122.

That is, when the discharging door 172 is at the first position DP1, the restriction member 178 is provided so that the other end of the door body 174 is restricted by the unit body 122, and when the discharging door 172 is at the releasing position FDP, the restriction member 178 is provided so that the other end of the door body 174 is released from the unit body 122, and thus the discharging door 172 can rotate.

The restriction member 178 may be formed at the other end of the door body 174 to have a "ㄷ" shape. That is, the restriction member 178 has an insertion hole 178*a* formed by opening one surface thereof, and may be provided so that the end of the unit body 122 is inserted into the insertion hole 178*a* when the discharging door 172 is at the first position DP1, and the end of the unit body 122 is separated from the restriction member 178 when the discharging door 172 is at the releasing position FDP.

The door holder 180 serves to guide a movement of the discharging door 172 so that the discharging door 172 is moved among the first position DP1, the releasing position FDP and the second position DP2.

The door holder 180 may include a holder body 182, the sliding rail 184 and a holder hinge 187.

The holder body 182 may be provided to be rotatable by the holder hinge 187, and may be formed in a rod shape.

The sliding rail 184 may be provided so that the slider 176 is movable, and the discharging door 172 is moved between the first position DP1 and the releasing position FDP. The sliding rail 184 may be provided to be bent from both ends of the holder body 182 and then to extend therefrom. One pair of sliding rails 184 may be provided to face each other.

The sliding rail 184 may include the movement guide part 185 which is inserted into the above-described guide space 176*c* and guides the movement of the slider 176. The movement guide part 185 may be inserted into the guide space 176*c* provided between the pair of rail restricting parts 176*b* so as to guide the movement of the slider 176, and thus the movement of the slider 176 may be restricted in the first direction DW1 which is the forward and backward direction. That is, the slider 176 may be prevented from being separated from the sliding rail 184 in the second direction DW2 vertical to the first direction DW1.

One pair of coupling parts 186 are provided at inner sides of the pair of sliding rails 184 to be coupled into the pair of coupling grooves 176*d* of the slider 176. The pair of coupling parts 186 are disposed at upper and lower sides of the movement guide to restrict the pair of rail restricting parts 176*b*, and thus to stably support the slider 176.

The coupling parts 186 include the first coupling part 186*a* and the second coupling part 186*b* which is spaced from the first coupling part 186*a*. The coupling parts 186 are formed to protrude from the inner sides of the sliding rail 184, and provided to be coupled into the coupling grooves 176*d* of the slider 176.

The coupling grooves 176*d* of the slider 176 may be provided to be selectively coupled to the first coupling part 186*a* and the second coupling part 186*b*. That is, when the discharging door 172 is at the first position DP1, the coupling grooves 176*d* of the slider 176 are coupled to the first coupling part 186*a*, and when the discharging door 172 is at the releasing position FDP or the second position DP2, the coupling grooves 176*d* of the slider 176 is coupled to the second coupling part 186*b*.

The pair of sliding rails 184 may be provided to be elastically spaced from the holder body 182. Thus, when the slider 176 is moved between the first coupling part 186*a* and the second coupling part 186*b*, the pair of sliding rails 184 may be provided to be spaced apart from each other, and thus the slider 176 may be easily moved. With such a structure, the slider 176 may be selectively coupled to the first coupling part 186*a* or the second coupling part 186*b* through a sliding movement.

The holder hinge 187 may be provided on the holder body 182 so that the holder body 182 is hinged with a hinge part 123 of the unit body 122 by a rotation axis 187*a*. The holder hinge 187 may be provided so that the door holder 180 can rotate with respect to the unit body 122. That is, the holder hinge 187 may be provided so that the discharging door 172 is moved between the releasing position FDP and the second position DP2.

Hereinafter, an operation of the discharging assembly 170 according to the above-described structure will be described.

Figure 14A:
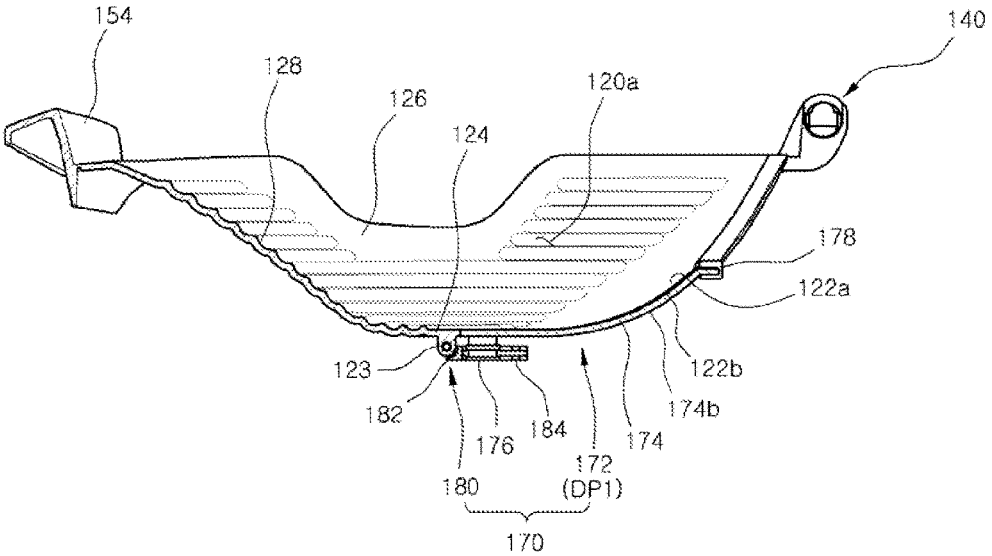
FIGS. 14A, 14B and 14C illustrate an operation of the auxiliary washing unit according to the first embodiment.
Figure 14B:
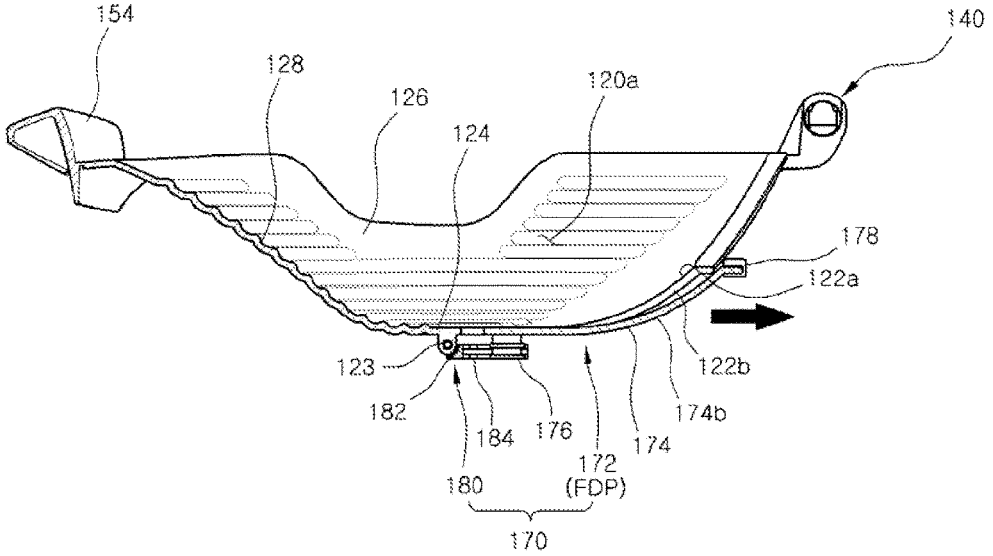
Figure 14C:
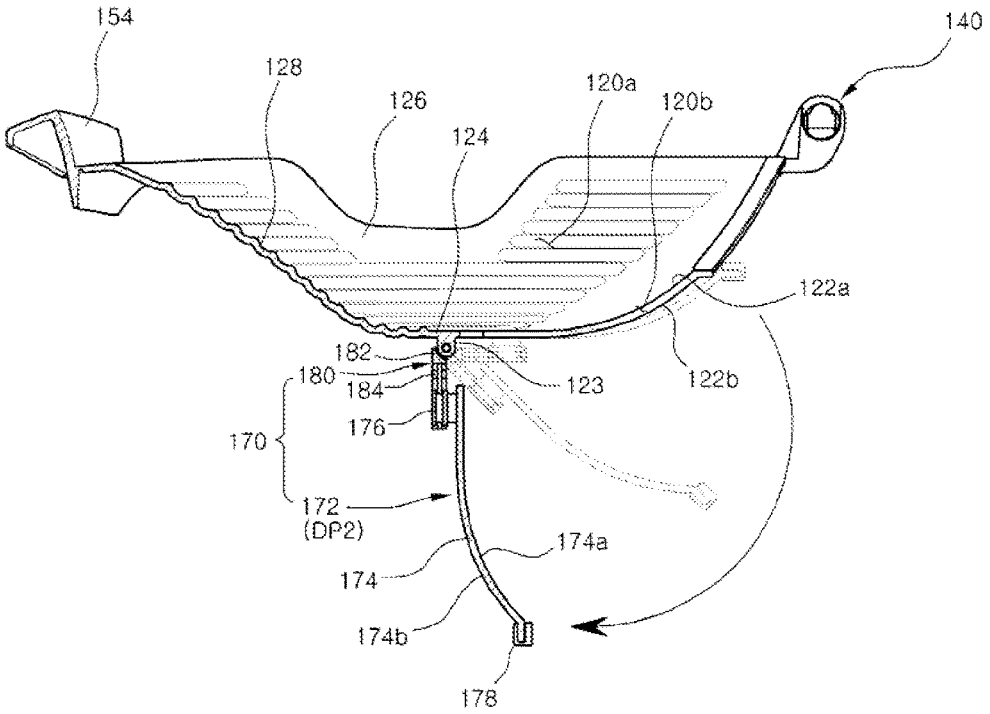

FIGS. 14A, 14B and 14C illustrate an operation of the auxiliary washing unit 120 according to the first embodiment.

Referring to FIG. 14A, when the discharging door 172 is at the first position DP1, one end of the door body 174 is restricted by the door holder 180, and the other end of the door body 174 is restricted by the restriction member 178, and thus the discharging hole 120*b* is in a closed state.

After the auxiliary washing in the auxiliary washing space 120*a* is finished, the discharging door 172 may be moved to the releasing position FDP to discharge the laundry and the washing water in the auxiliary washing space 120*a* to the main washing space 11*a*.

Referring to FIG. 14B, when the discharging door 172 is moved in the first direction DW1, and thus moved from the first position DP1 to the releasing position FDP, the slider 176 of the discharging door 172 is slid along the sliding rail 184 from the first coupling part 186*a* and seated at the second coupling part 186*b*. Also, the restriction member 178 of the discharging door 172 is separated from the unit body 122, and the other end of the door body 174 is released so as to be rotatable by the door holder 180.

Therefore, as illustrated in FIG. 14C, the other end of the discharging door 172 is released, and thus the discharging door 172 is in a state in which it is rotatable by the door holder 180. Therefore, the discharging door 172 rotates from the releasing position FDP to the second position DP2, and thus the discharging hole 120*b* is opened, and the laundry and the washing water in the auxiliary washing space 120*a* may be discharged to the main washing space 11*a*.

It has been described above that the discharging door 172 is moved among the first position DP1, the releasing position FDP and the second position DP2. However, the releasing position FDP of the discharging door 172 may be omitted, and the door holder 180 may rotate and support the discharging door 172 so that the discharging door 172 rotates between the first position DP1 and the second position DP2.

Also, in an embodiment, for convenience of explanation, it has been described that the discharging door 172 is disposed at a rear portion of the auxiliary washing unit 120. However, an arrangement direction of the discharging door 172, and the first direction DW1 in which the discharging door 172 is moved between the first position DP1 and the releasing position FDP are not limited.

Hereinafter, a washing machine according to the second embodiment will be described.

Elements that are the same in this embodiment as in the above-described embodiment will not be described again.

In an embodiment, a structure of a discharging assembly 270 may be different from that of the discharging assembly according to the first embodiment.

Figure 15:
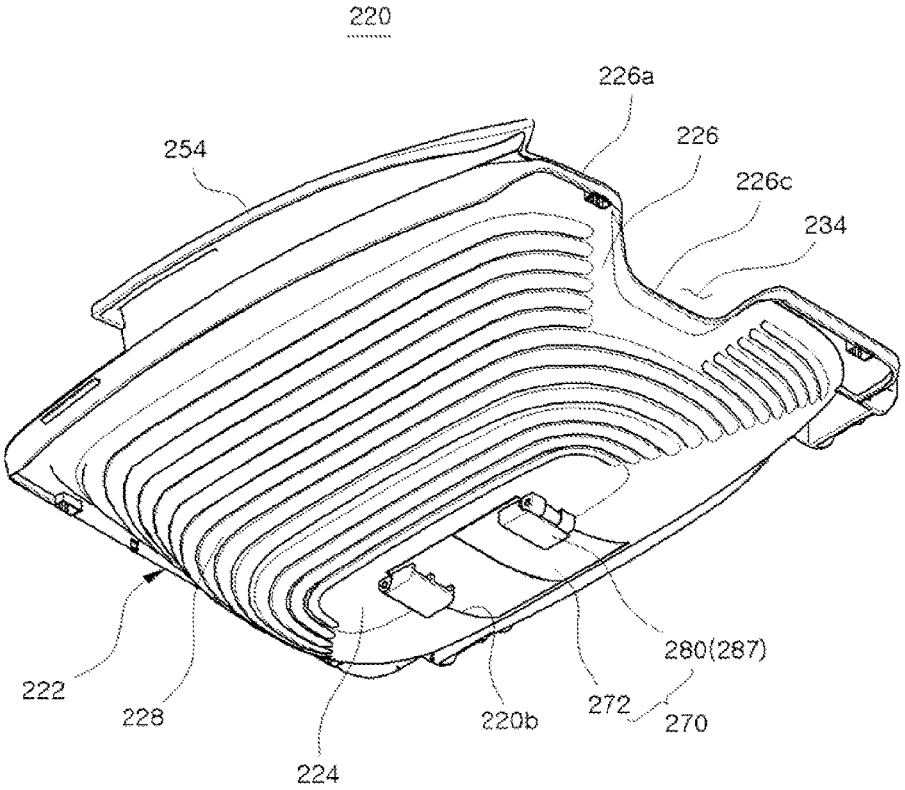
FIG. 15 is a lower perspective view of an auxiliary washing unit according to a second embodiment.

FIG. 15 is a lower perspective view of an auxiliary washing unit 220 according to a second embodiment.

The auxiliary washing unit 220 may include the discharging assembly 270.

The auxiliary washing unit 220 has an auxiliary opening 220*b* through which the laundry or the washing water is discharged from an auxiliary washing space 220*a* to the main washing space 11*a*. The discharging assembly 270 may be provided to open and close the auxiliary opening 220*b* and thus to selectively discharge the laundry or the washing water in the auxiliary washing space 220*a* to the main washing space 11*a*.

As described above, a unit body 222 may include a bottom part 224 and a side part 226. At least a part of the auxiliary opening 220*b* may be formed at the bottom part 224. That is, the auxiliary opening 220*b* may be formed from the bottom part 224, and thus when the laundry or the washing water is discharged to the main washing space 11*a* through the discharging assembly 270, the laundry or the washing water in the auxiliary washing space 220*a* may be completely and easily discharged.

The discharging assembly 270 includes a discharging door 272 and a door holder 280 which guides an operation of the discharging door 272.

The discharging door 272 may be provided to open and close the auxiliary opening 220*b*. A shape of the discharging door 272 is not limited, and may be provided to coincide with the auxiliary opening 220*b*, such that the auxiliary washing space 220*a* may be formed at an inner side of the auxiliary washing unit 220 when the auxiliary opening 220*b* is closed.

The discharging door 272 may be provided to be moved between a first position DP1 in which the auxiliary opening is closed, and a second position DP2 in which the discharging door 272 rotates from the first position DP1 so as to open the auxiliary opening 220*b*.

In the embodiment, one pair of discharging doors 272 may be provided to be bilaterally opened and closed centering on the auxiliary opening 220*b*.

The discharging door 272 may be provided to be fixed at the first position DP1 and thus to be prevented from undesirably rotating to the second position DP2. To this end, a fixing device (not shown) may be separately installed at the discharging door 272, and the discharging door 272 may be formed to endure a weight of the laundry and the washing water between the unit body 222 and the door holder 280, and the method thereof is not limited.

The door holder 280 may include a holder hinge 287. The holder hinge 287 may be provided between one pair of the discharging doors 272 and the unit body 222 so that the pair of the discharging doors 272 are rotatable with respect to the unit body 222. That is, the holder hinge 287 may be fixed to a rear surface of the discharging door 272, and coupled so as to be rotatable with respect to the unit body 222, thereby rotating the discharging door 272.

Hereinafter, an operation of the discharging assembly 270 according to such a structure will be described.

Figure 16A:
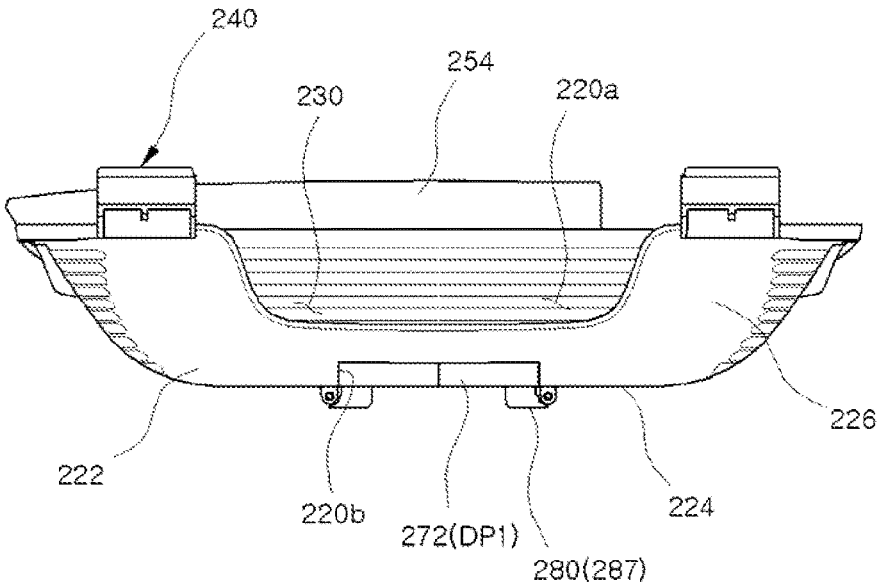
FIGS. 16A, 16B and 16C illustrate an operation of the auxiliary washing unit according to the second embodiment.
Figure 16B:
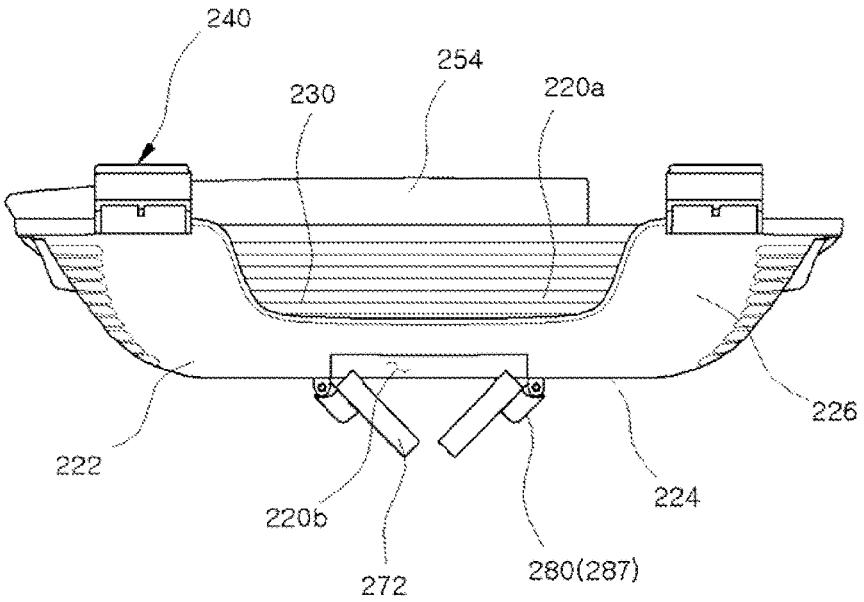
Figure 16C:
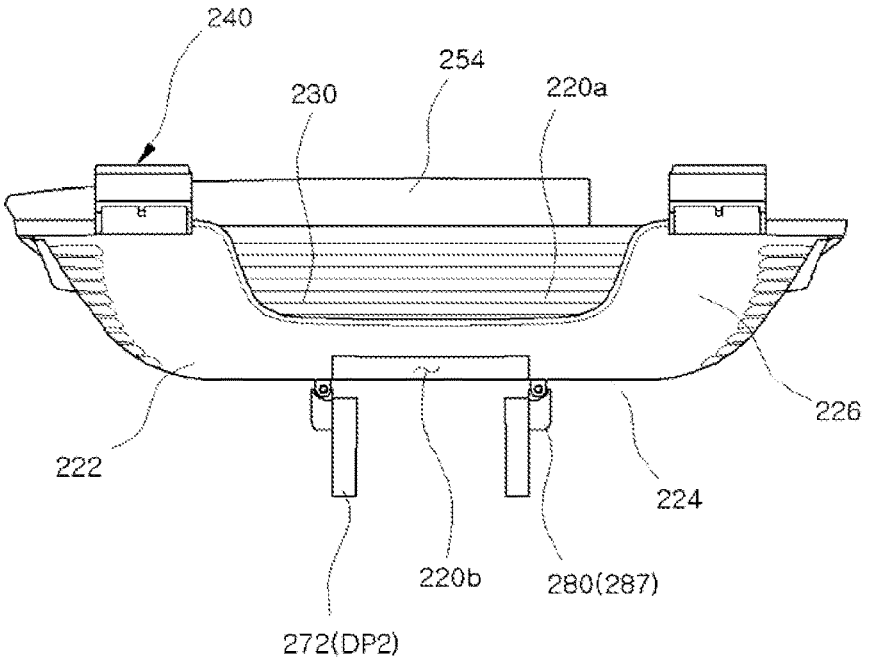

FIGS. 16A, 16B and 16C illustrate an operation of the auxiliary washing unit 220 according to a second embodiment.

Referring to FIG. 16A, when the discharging door 272 is at the first position DP1, the discharging door 272 closes the auxiliary opening 220*b*, and thus the auxiliary washing may be performed at the auxiliary washing space 220*a*.

After the auxiliary washing is finished at the auxiliary washing space 220*a*, the discharging door 272 may be rotated from the first position DP1 to the second position DP2 so as to discharge the laundry and the washing water in the auxiliary washing space 220*a* to the main washing space 11*a*.

Referring to FIGS. 16B and 16C, the discharging door 272 rotates to the second position DP2, and the auxiliary opening 220*b* is opened, and thus the laundry and the washing water in the auxiliary washing space 220*a* may fall into the main washing space 11*a* disposed under the auxiliary washing space 220*a*.

Hereinafter, a washing machine according to a third embodiment will be described.

Elements that are the same in this embodiment as in the above-described embodiment will not be described again.

In the embodiment, a structure of a discharging assembly 370 may be different from that of the discharging assembly according to the first embodiment.

Figure 17:
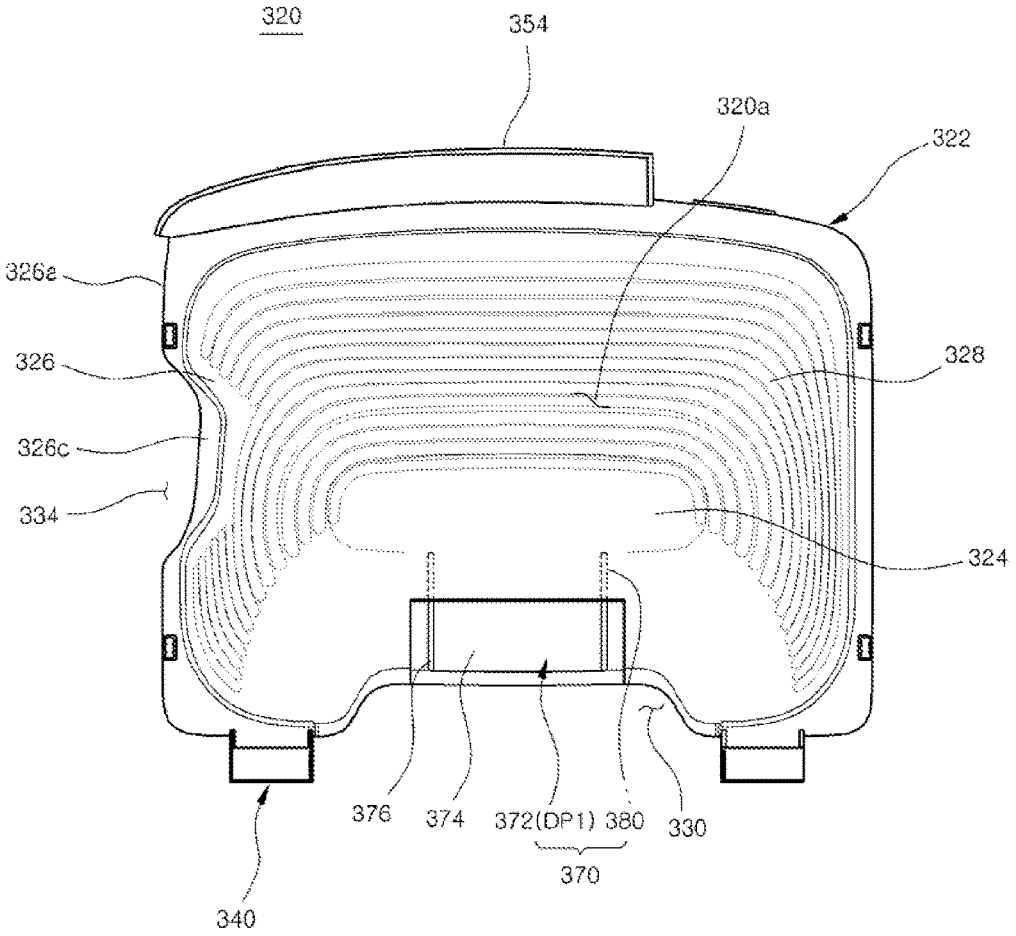
FIGS. 17 and 18 are lower front views of an auxiliary washing unit according to a third embodiment.
Figure 18:
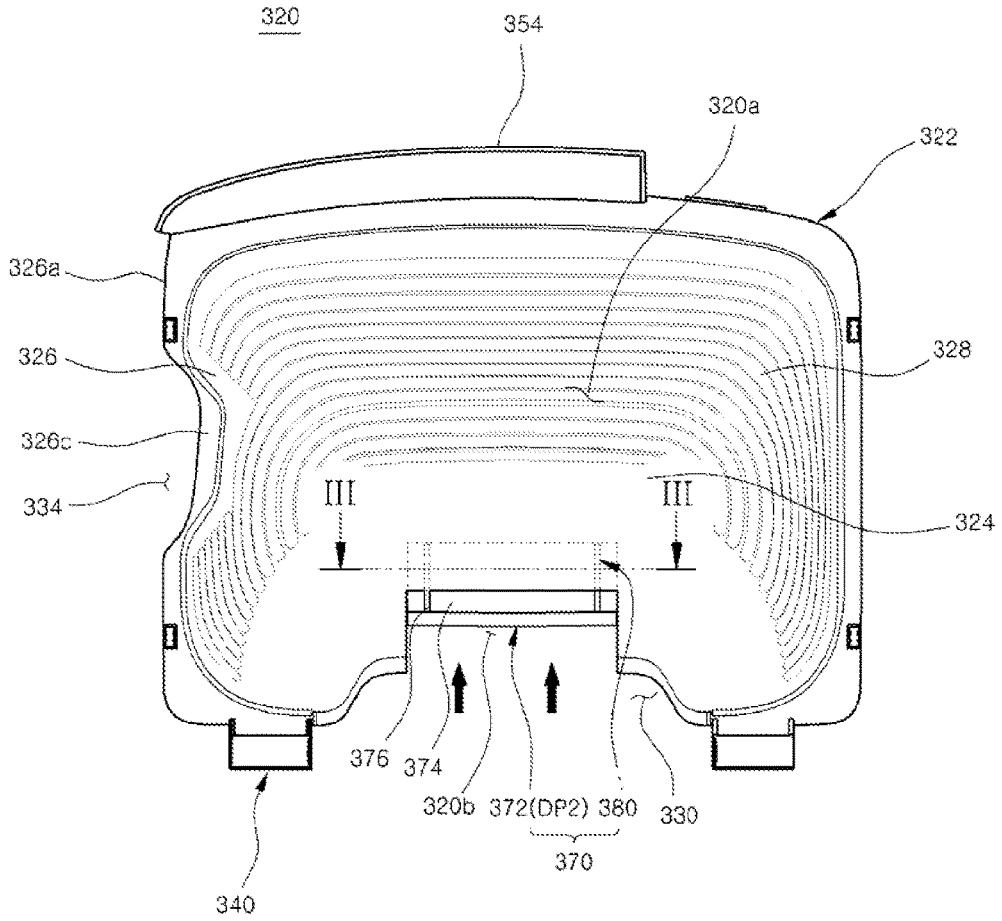
Figure 19:
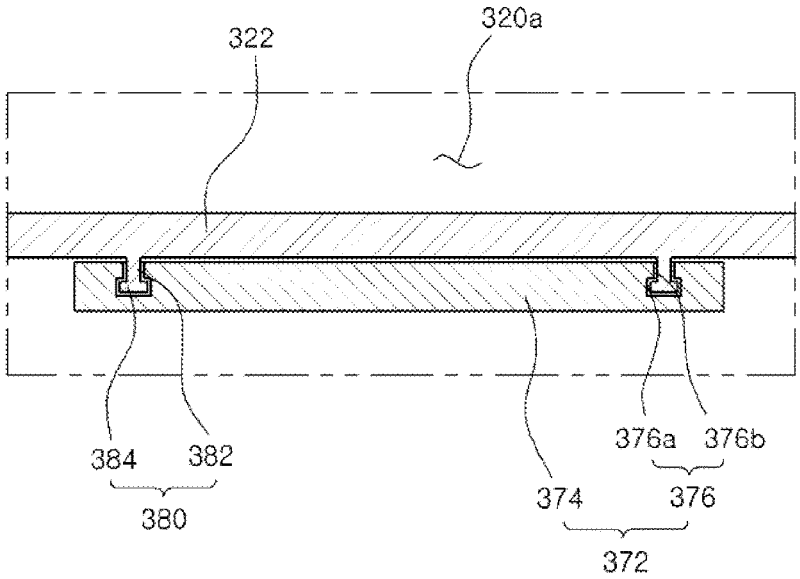
FIG. 19 is a cross-sectional view taken along line III-III of FIG. 18.

FIGS. 17 and 18 are lower front views of an auxiliary washing unit according to a third embodiment, and FIG. 19 is a cross-sectional view taken along line III-III of FIG. 18.

An auxiliary washing unit 320 may include the discharging assembly 370.

The auxiliary washing unit 320 has an auxiliary opening 320*b* through which the laundry or the washing water is discharged from an auxiliary washing space 320*a* to the main washing space 11*a*. The discharging assembly 370 may be provided to open and close the auxiliary opening 320*b* and thus to selectively discharge the laundry or the washing water in the auxiliary washing space 320*a* to the main washing space 11*a*.

As described above, a unit body 322 may include a bottom part 324 and a side part 326. At least a part of the auxiliary opening 320*b* may be formed at the bottom part 324. That is, the auxiliary opening 320*b* may be formed from the bottom part 324, and thus when the laundry or the washing water is discharged to the main washing space 11*a* through the discharging assembly 370, the laundry or the washing water in the auxiliary washing space 320*a* may be completely and easily discharged.

The discharging assembly 370 includes a discharging door 372 and a door rail 380 which guides an operation of the discharging door 372.

The discharging door 372 may be provided to open and close the auxiliary opening 320*b*. A shape of the discharging door 372 is not limited, and may be provided to coincide with the auxiliary opening 320*b*, such that an auxiliary washing space 320*a* may be formed at an inner side of the auxiliary washing unit 320 when the auxiliary opening 320*b* is closed.

The discharging door 372 may be provided to be moved between a first position DP1 in which the auxiliary opening 320*b* is closed, and a second position DP2 in which the discharging door 372 rotates from the first position DP1 so as to open the auxiliary opening 320*b*.

The discharging door 372 may be provided to be slid from the first position DP1 to the second position DP2. The discharging door 372 includes a door body 374, and a moving groove 376 which may be provided in an upper surface of the door body 374. The door rail 380 to be described later may be inserted into the moving groove 376 to guide a movement of the discharging door 372.

In an embodiment, the discharging door 372 may be moved from a rear side of the auxiliary washing unit 320 in a first direction DW1 which is a forward and backward direction of the auxiliary washing unit 320. However, a moving direction of the discharging door 372 is not limited.

The moving groove 376 may be provided to guide the movement of the discharging door 372. Therefore, the moving groove 376 may formed to be recessed in an upper portion of the door body 374, and may extend in the first direction DW1.

The door rail 380 may be provided to guide a movement of the discharging door 372.

The door rail 380 may be provided at an outer surface of the auxiliary washing unit 320 which is an opposite surface to an inner surface forming the auxiliary washing space 320*a*. The door rail 380 may be disposed at the outer surface of the auxiliary washing unit 320 in the first direction DW1 which is a moving direction of the discharging door 372. In an embodiment, one pair of moving grooves 376 and one pair of door rails 380 may be provided, and the numbers thereof are not limited.

The door rail 380 may include a door rail body 382 and a door rail flange 384.

The door rail body 382 may be formed to extend from the outer surface of the auxiliary washing unit 320, and the door rail flange 384 may be provided from an end of the door rail body 382 in parallel with the auxiliary washing unit 320 so as to have a flange shape. The moving groove 376 includes a first moving groove 376*a* which corresponds to the door rail body 382, and a second moving groove 376*b* which corresponds to the door rail flange 384 and is wider than the first moving groove 376*a*. The door rail flange 384 which is wider than the door rail body 382 may be provided to be inserted into the second moving groove 376*b* which is wider than the first moving groove 376*a* and to be prevented from being separated through the first moving groove 376*a*.

Through such a structure, the discharging door 372 may be prevented from being separated from the door rail 380 while being moved along the door rail 380.

Hereinafter, an operation of the discharging assembly 370 according to such a structure will be described.

Figure 20A:
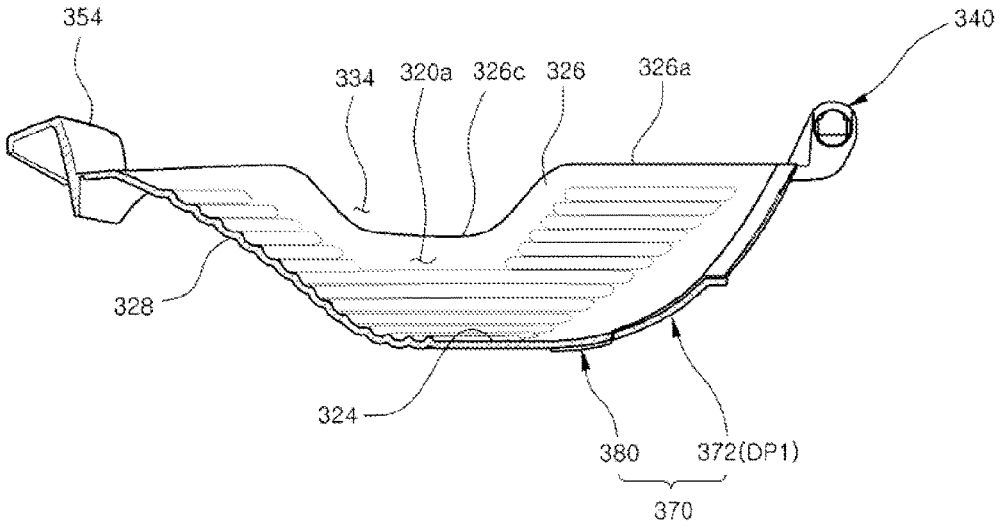
FIGS. 20A and 20B illustrate an operation of the auxiliary washing unit according to the third embodiment.
Figure 20B:
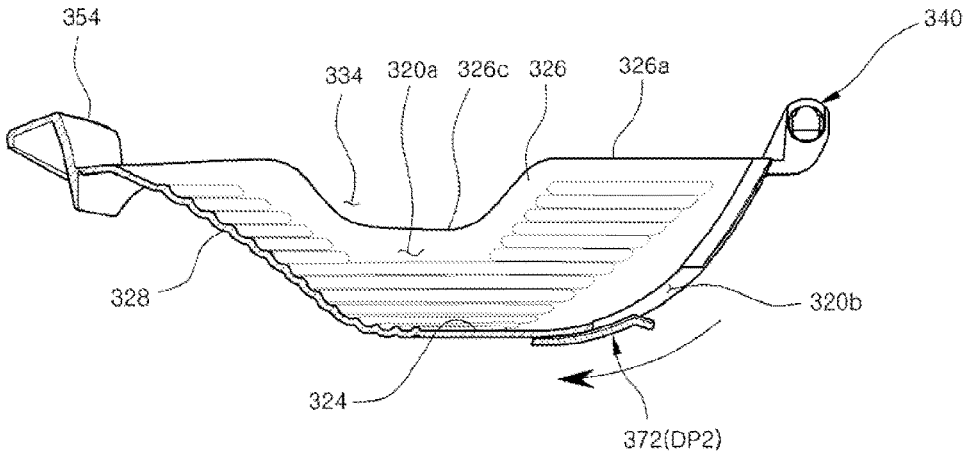

FIGS. 20A and 20B illustrate an operation of the auxiliary washing unit 320 according to the third embodiment.

Referring to FIG. 20A, when the discharging door 372 is at the first position DP1, the discharging door 372 closes the auxiliary opening 320*b*, and thus the auxiliary washing may be performed at the auxiliary washing space 320*a*.

After the auxiliary washing is finished at the auxiliary washing space 320*a*, the discharging door 372 may be slid from the first position DP1 to the second position DP2 so as to discharge the laundry and the washing water in the auxiliary washing space 320*a* to the main washing space 11*a*.

Referring to FIG. 20B, the discharging door 372 may be moved from the first position DP1 to the second position DP2 along the door rail 380. The door rail body 382 may be inserted into the first moving groove 376*a*, and the door rail flange 384 may be inserted into the second moving groove 376*b*, and thus a movement of the discharging door 372 may be guided.

In this process, the auxiliary opening 320*b* is opened, and thus the laundry and the washing water in the auxiliary washing space 320*a* may fall into the main washing space 11*a* disposed under the auxiliary washing space 320*a*.

Figure 21:
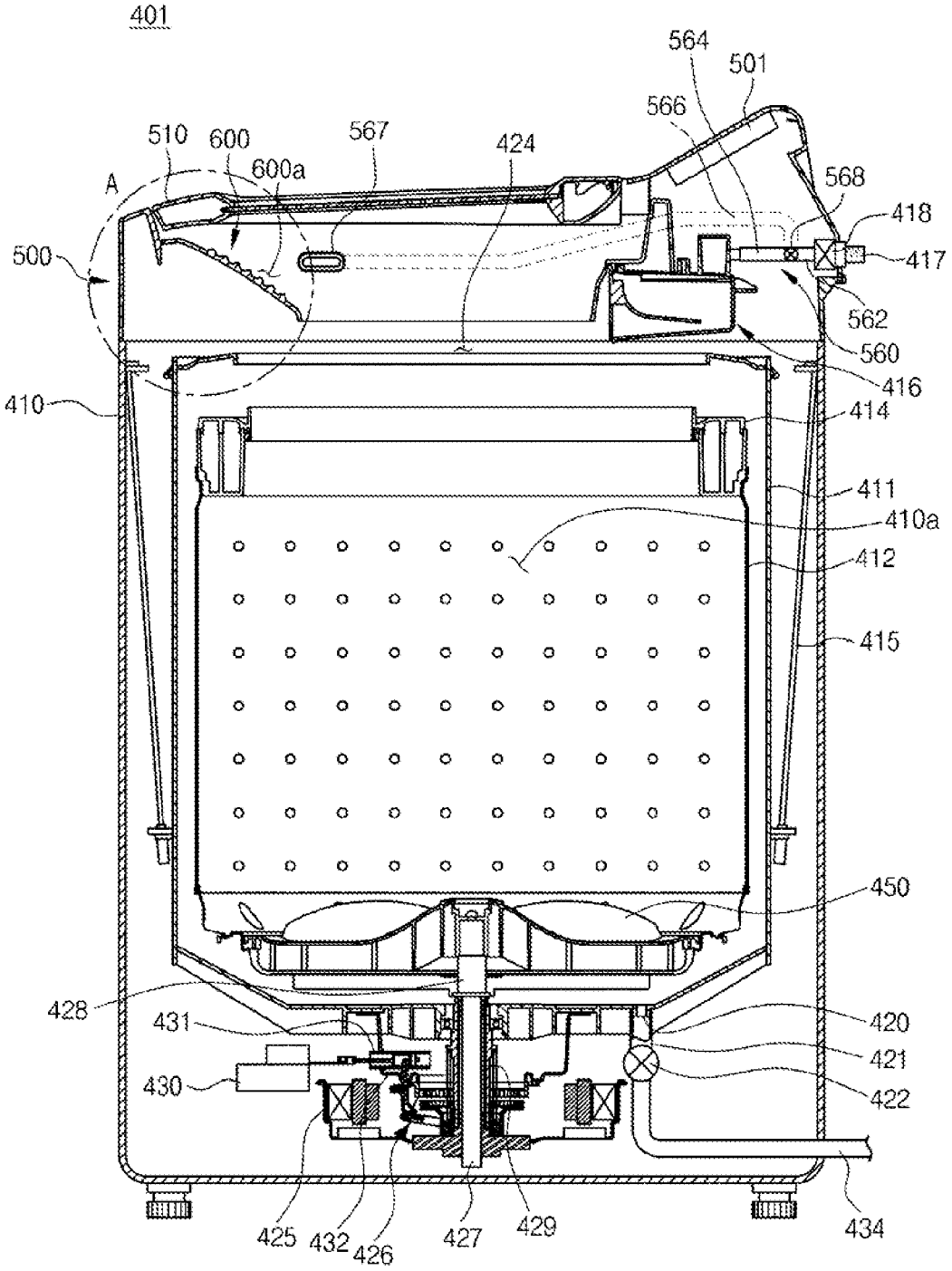
FIG. 21 is a cross-sectional view of a washing machine according to a fourth embodiment.

FIG. 21 is a cross-sectional view of a washing machine according to a fourth embodiment.

As illustrated in FIG. 21, a washing machine 401 includes, for example, a main body 410 which forms an exterior, a fixed tub 411 which is disposed in the main body 410 to store washing water, a rotating tub 412 which is rotatably disposed in the fixed tub 411, and a pulsator 450 which is disposed in the rotating tub 412 to generate a water flow.

An opening 424 through which the laundry is put into the rotating tub 412 may be formed at an upper portion of the main body 410, and a top cover assembly 500 may be provided at the opening 424.

A door 510 may be rotatably installed on an upper surface of the top cover assembly 500 to open and close the opening 424, and a control part 501 including a button 501*a* (FIG. 22) for controlling the washing machine 401 may be provided at a rear end of the upper surface thereof.

The fixed tub 411 may be supported by the main body 410 through a suspension device 415.

A water supply pipe 417 which supplies the washing water into the fixed tub 411 may be installed above the fixed tub 411. One side of the water supply pipe 417 may be connected to an external water supply source (not shown), and the other end thereof may be connected to a detergent supply device 416. Water supplied through the water supply pipe 417 passes through the detergent supply device 416 and is then supplied into the fixed tub 411 with a detergent. A water supply valve 418 may be installed at the water supply pipe 417 to control water supply.

The rotating tub 412 may be formed in a cylindrical shape of which an upper portion is opened, and a plurality of spin-drying holes 413 are formed at a side surface of the rotating tub 412. A balancer 414 may be installed at an upper portion of the rotating tub 412 so that the rotating tub 412 rotates stably during high-speed rotation.

A motor 425 which generates a driving force for rotating the rotating tub 412 and the pulsator 450, and a power switching device 426 which simultaneously or selectively supplies the driving force generated from the motor 425 to the rotating tub 412 and the pulsator 450 are installed at a lower exterior of the fixed tub 411.

A hollow spin-drying shaft 429 may be coupled to the rotating tub 412, and a washing shaft 427 installed in a hollow portion of the spin-drying shaft 429 may be coupled to the pulsator 450 through a washing shaft coupling part 428. The motor 425 may simultaneously or selectively supply the driving force to the rotating tub 412 and the pulsator 450 according to an up and down movement of the power switching device 426.

The power switching device 426 may include an actuator 430 which generates a driving force for power conversion, a rod part 431 which performs a linear motion according to an operation of the actuator 430, and a clutch part 432 which is connected to the rod part 431 to rotate according to an operation of the rod part 431.

A drain 420 may be formed at a bottom of the fixed tub 411 to discharge the washing water stored in the fixed tub 411, and a first drain pipe 421 may be connected to the drain 420. A drain valve 422 which controls drainage may be installed at the first drain pipe 421. An outlet port of the drain valve 422 may be connected to a second drain pipe 434 which discharges the washing water to an outside.

Figure 22:
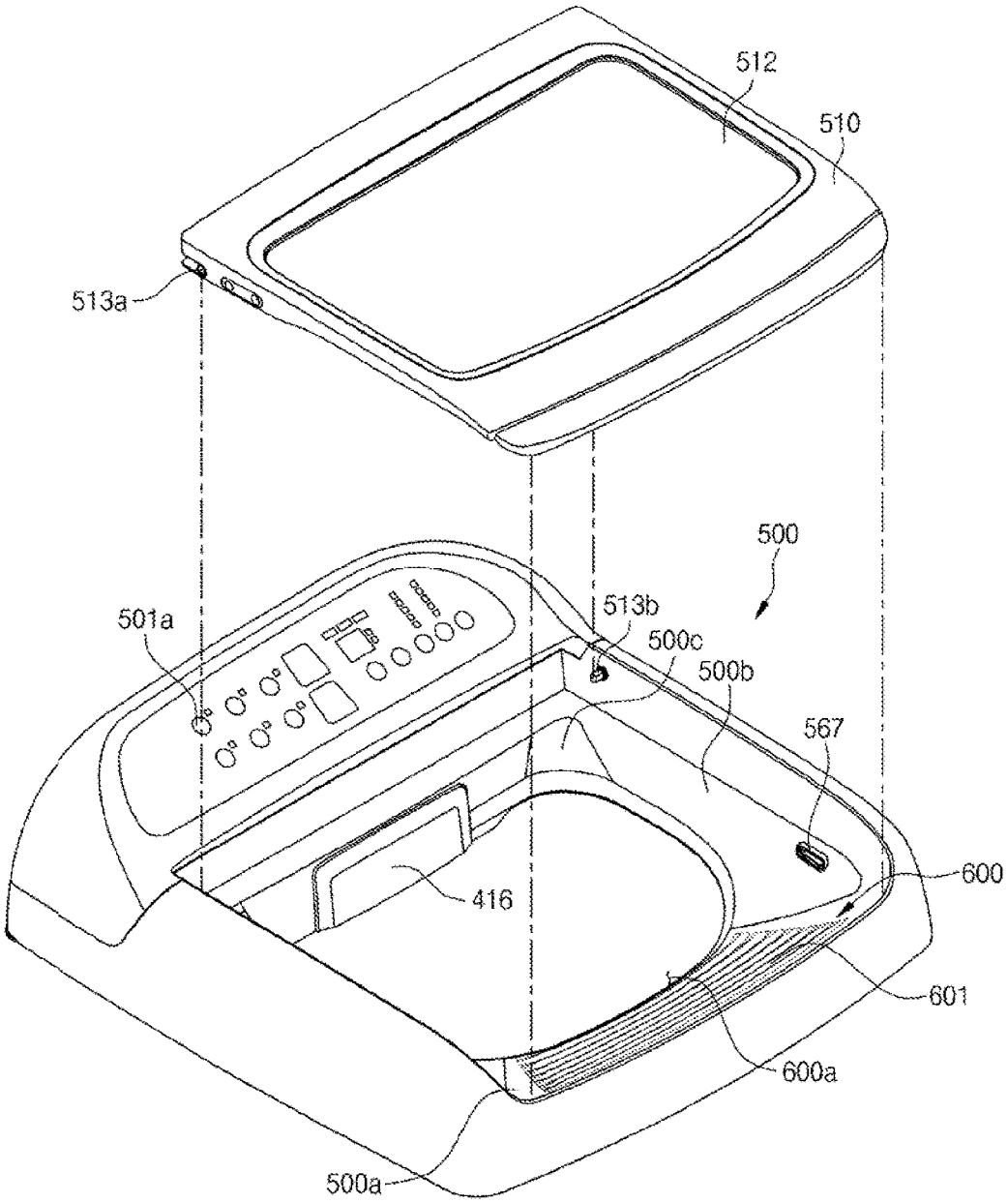
FIG. 22 is a perspective view schematically illustrating an auxiliary washing part of the washing machine according to the fourth embodiment.
Figure 23:
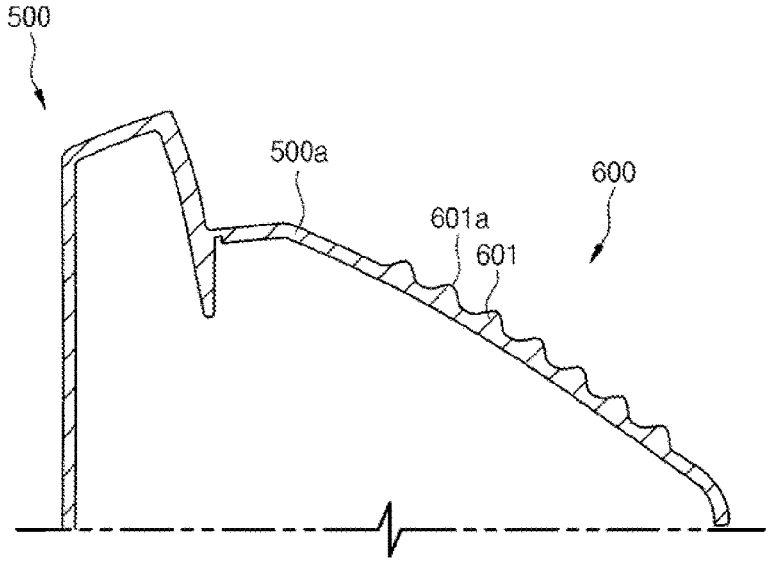
FIG. 23 is an enlarged view of a portion A of FIG. 21.
Figure 24:
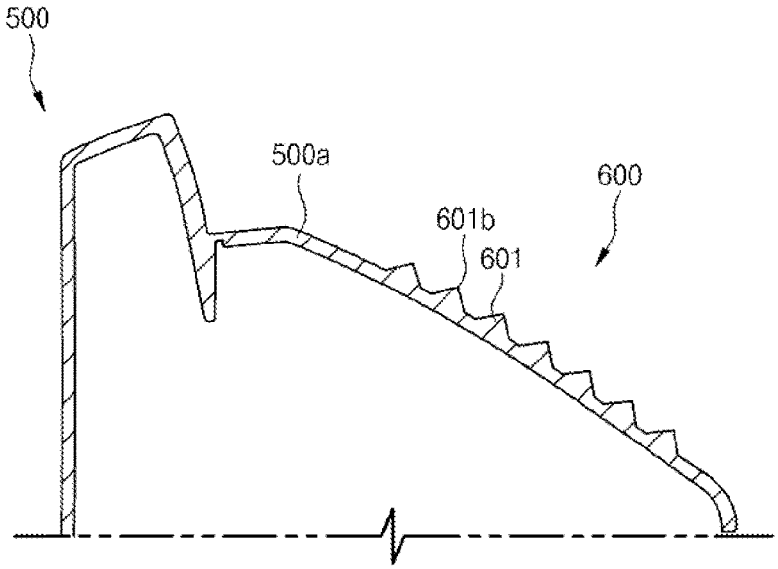
FIG. 24 is a cross-sectional view illustrating an auxiliary washing part having a different shape from that of the fourth embodiment.
Figure 25:
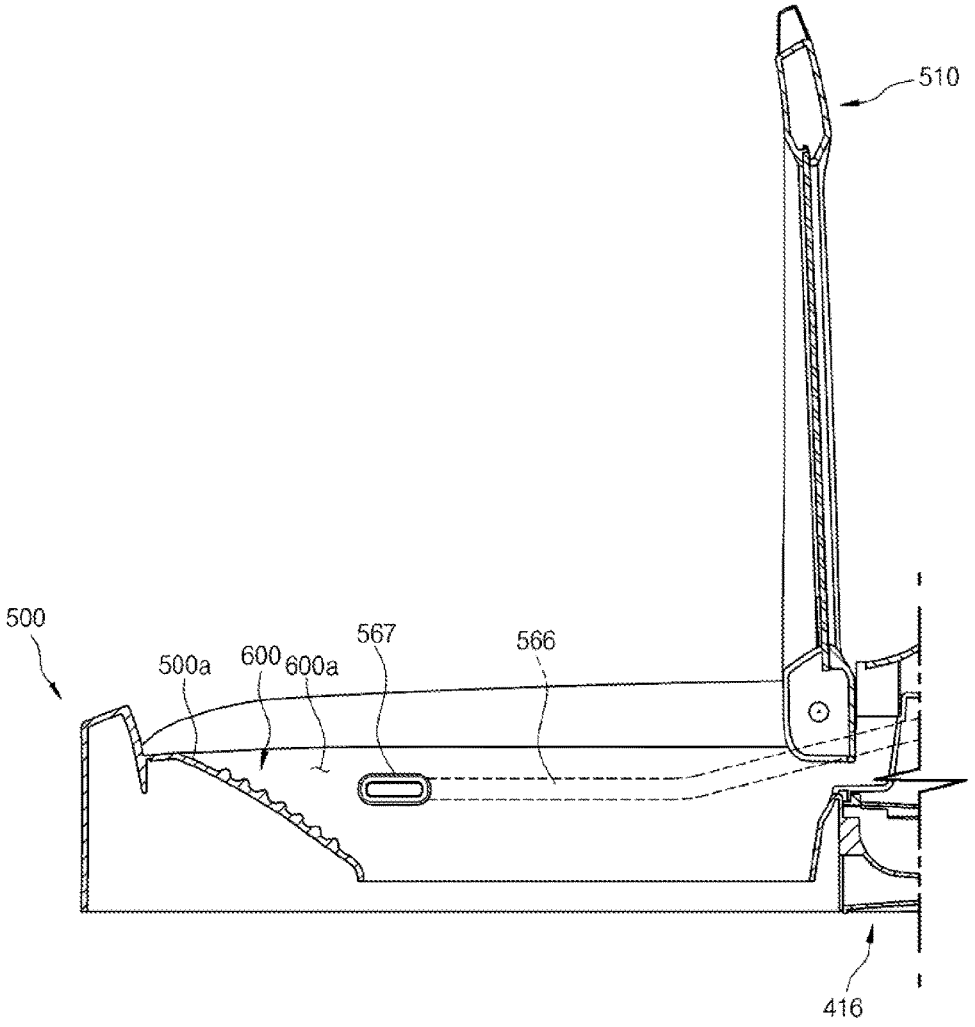
FIG. 25 illustrates an operation of the auxiliary washing part according to the fourth embodiment.

FIG. 22 is a perspective view schematically illustrating an auxiliary washing part of the washing machine according to the fourth embodiment, FIG. 23 is an enlarged view of a portion A of FIG. 21, FIG. 24 is a cross-sectional view illustrating an auxiliary washing part having a different shape from that of the fourth embodiment, and FIG. 25 illustrates an operation of the auxiliary washing part according to the fourth embodiment.

The top cover assembly 500 may be provided at the opening 424. The door 510 provided at the top cover assembly 500 may be installed to be rotatable by a hinge part 513 and thus to open and close the opening 424.

The hinge part 513 may include a first hinge 513*a* which is formed at both rear ends of the door 510, and a second hinge 513*b* which is formed at the top cover assembly 500 to correspond the first hinge 513*a*.

A transparent member 512 may be provided at the door 510 so that an inner side is visible even in a state in which the door 510 closes the opening 424.

The top cover assembly 500 may include a first inner surface 500*a* which forms a front inner surface, a second inner surface 500*b* which forms both side surfaces, and a third inner surface 500*c* which forms a rear inner surface.

An auxiliary washing part 600 may be formed at at least one surface of the first to third inner surfaces 500*a*, 500*b* and 500*c* so that the hand-washing can be performed therein.

The first to third inner surfaces 500*a*, 500*b* and 500*c* of the top cover assembly 500 may be formed to be inclined toward a center thereof.

The auxiliary washing part 600 has an auxiliary washing space 600*a*, which is formed separately from a main washing space 410*a* formed by the fixed tub 411 and the rotating tub 412 for performing the hand-washing.

The main washing space 410*a* and the auxiliary washing space 600*a* are separated from each other such that the washing in each space can be independently performed. Also, the washing in the main washing space 410*a* and the auxiliary washing space 600*a* may be separately or simultaneously performed.

The auxiliary washing part 600 may be disposed at the first inner surface 500*a* of the top cover assembly 500 and includes a plurality of frictional protrusions 601.

The plurality of frictional protrusions 601 may be formed in parallel with each other in a transverse direction of the first inner surface 500*a*. The frictional protrusions 601 may be formed to protrude or be recessed in a longitudinal direction of the first inner surface 500*a*. The frictional protrusions 601 serve to increase frictional force with the laundry when the hand-washing is performed such that dirt is easily washed from the laundry.

The frictional protrusions 601 may be formed to have a round shape 601*a*, such that a curve is formed on the first inner surface 500*a*.

The frictional protrusions 601 may be formed in a shape including a straight line. However, a shape and an arrangement of the frictional protrusions 601 are not limited. For example, the frictional protrusions 601 may be formed between the second inner surface 500*b* of the top cover assembly 500 and the third inner surface 500*c* thereof.

Meanwhile, the top cover assembly 500 may include a water supply device 560 to supply the water to the main washing space 410*a* and the auxiliary washing space 600*a*.

The water supply device 560 may include a water supply pipe 562, a main water supply pipe 564, an auxiliary water supply pipe 566 and a switching unit 568.

One end of the water supply pipe 562 may be connected to the water supply valve 418, and the other end thereof may be connected to the switching unit 568. The water supply pipe 562 may be provided to deliver the washing water supplied from the water supply valve 418 to the switching unit 568.

The main water supply pipe 564 may be provided to supply the water into the main washing space 410*a*. One end of the main water supply pipe 564 may be connected to the detergent supply device 416, and the other end thereof may be connected to the switching unit 568.

Also, the auxiliary water supply pipe 566 may be provided to supply the water into the auxiliary washing space 600*a* of the auxiliary washing part 600. One end of the auxiliary water supply pipe 566 may be connected to an auxiliary water supply port 567, and the other end thereof may be connected to the switching unit 568.

The switching unit 568 may be provided to selectively supply the washing water delivered from the water supply pipe 562 to one of the main water supply pipe 564 and the auxiliary water supply pipe 566. That is, the switching unit 568 may be provided so that the washing water is supplied into the washing space through at least one of the main water supply pipe 564 and the auxiliary water supply pipe 566 by controlling the switching unit 568. The switching unit 568 may include a three-way valve.

In an embodiment, the main water supply pipe 564 and the auxiliary water supply pipe 566 are provided to be branched from the water supply pipe 562 with the switching unit 568 interposed therebetween. The main water supply pipe 564 and the auxiliary water supply pipe 566 may be connected to the water supply valve 418, and thus the washing water may be supplied by controlling the water supply valve 418. That is, the main water supply pipe 564 of which one end may be connected to the detergent supply device 416, and the auxiliary water supply pipe 566 of which one end may be connected to the auxiliary water supply port 567 may be provided so that each of the other ends thereof may be connected to the water supply valve 418.

Also, in an embodiment, the washing water may be selectively supplied to the main water supply pipe 564 and the auxiliary water supply pipe 566, but may be simultaneously supplied to the main water supply pipe 564 and the auxiliary water supply pipe 566.

The auxiliary water supply port 567 may be provided to be in communication with the auxiliary water supply pipe 566. The auxiliary water supply port 567 may be provided at one side of the auxiliary washing part 600 to supply the water into the auxiliary washing space 600*a* provided at an upper side of the auxiliary washing part 600.

Therefore, when the auxiliary washing is performed, the washing water may be supplied through the auxiliary water supply port 567, and preliminary washing of the laundry may be performed using the supplied washing water and the frictional protrusions 601 of the auxiliary washing part 600.

Meanwhile, splattering of the water generated during the preliminary washing may be prevented by a slope of the second and third inner surfaces 500*b* and 500*c* of the top cover assembly 500.

Also, since the frictional protrusions 601 of the auxiliary washing part 600 are formed to have the round shape, water stagnation at the frictional protrusions 601 may be prevented.

Figure 26:
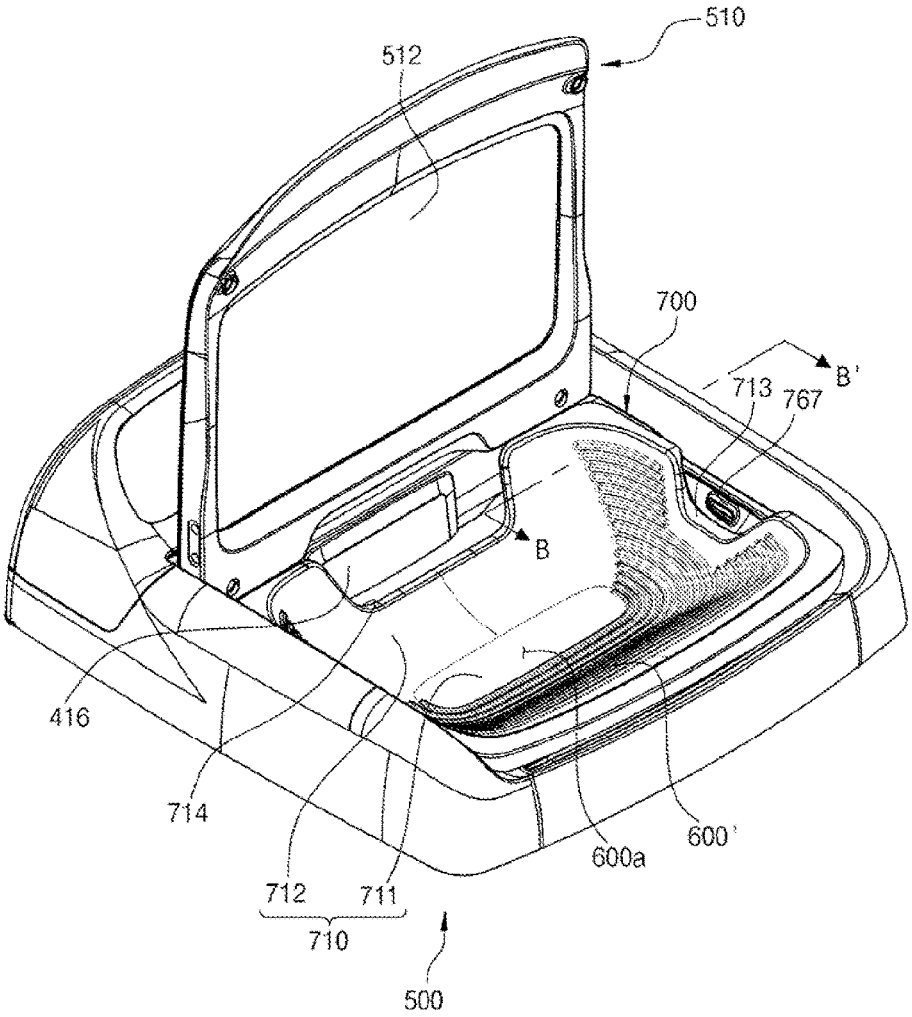
FIG. 26 is a perspective view schematically illustrating a washing machine in which an auxiliary washing unit according to a fifth embodiment is installed.
Figure 27:
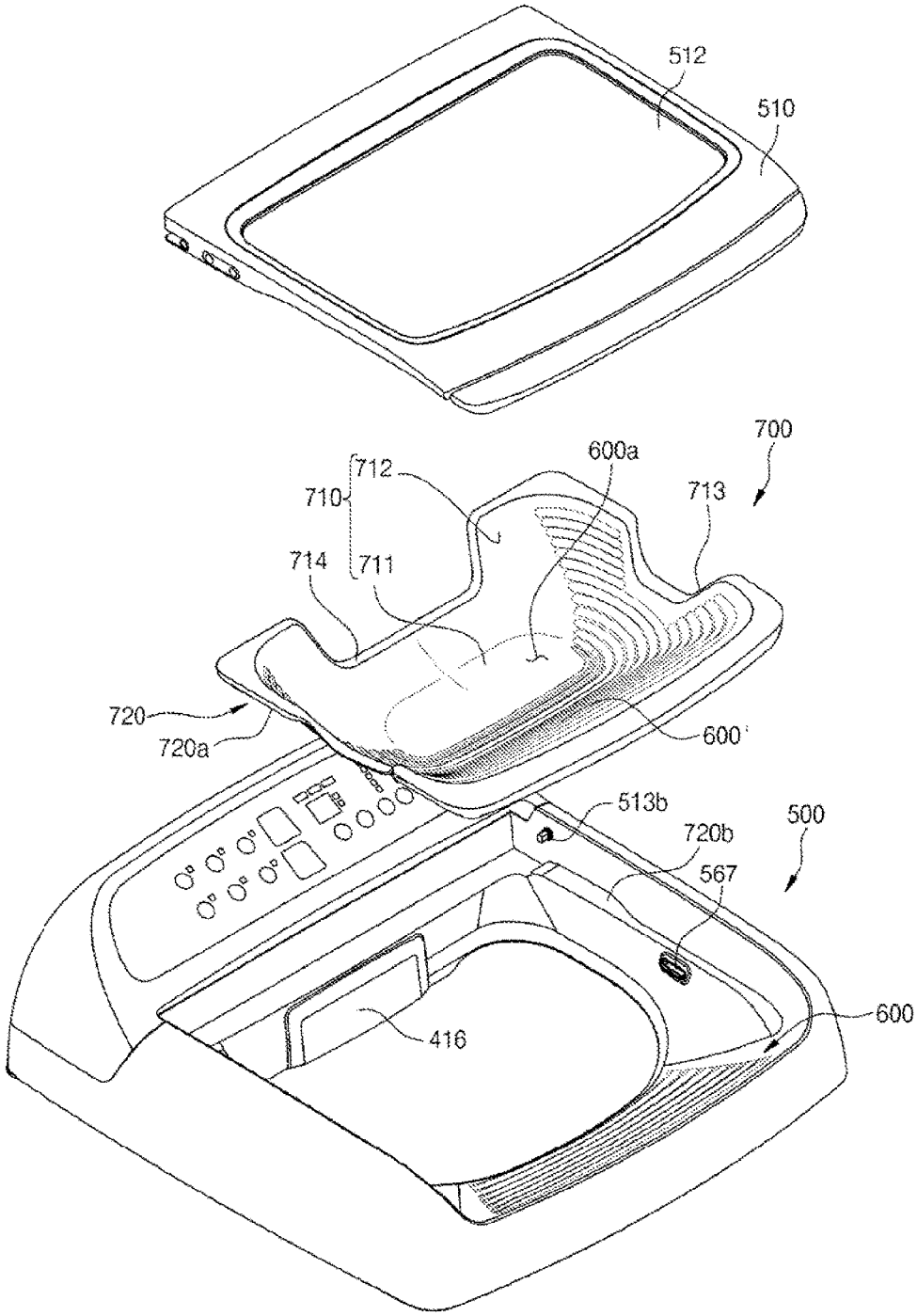
FIG. 27 is an exploded perspective view schematically illustrating the auxiliary washing unit of the washing machine according to the fifth embodiment
Figure 28:
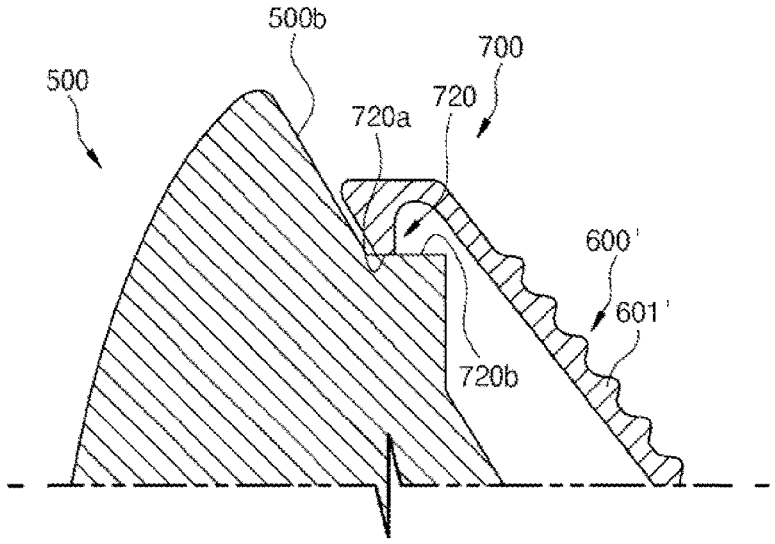
FIG. 28 is a cross-sectional view taken along line B-B' of FIG. 26.
Figure 29:
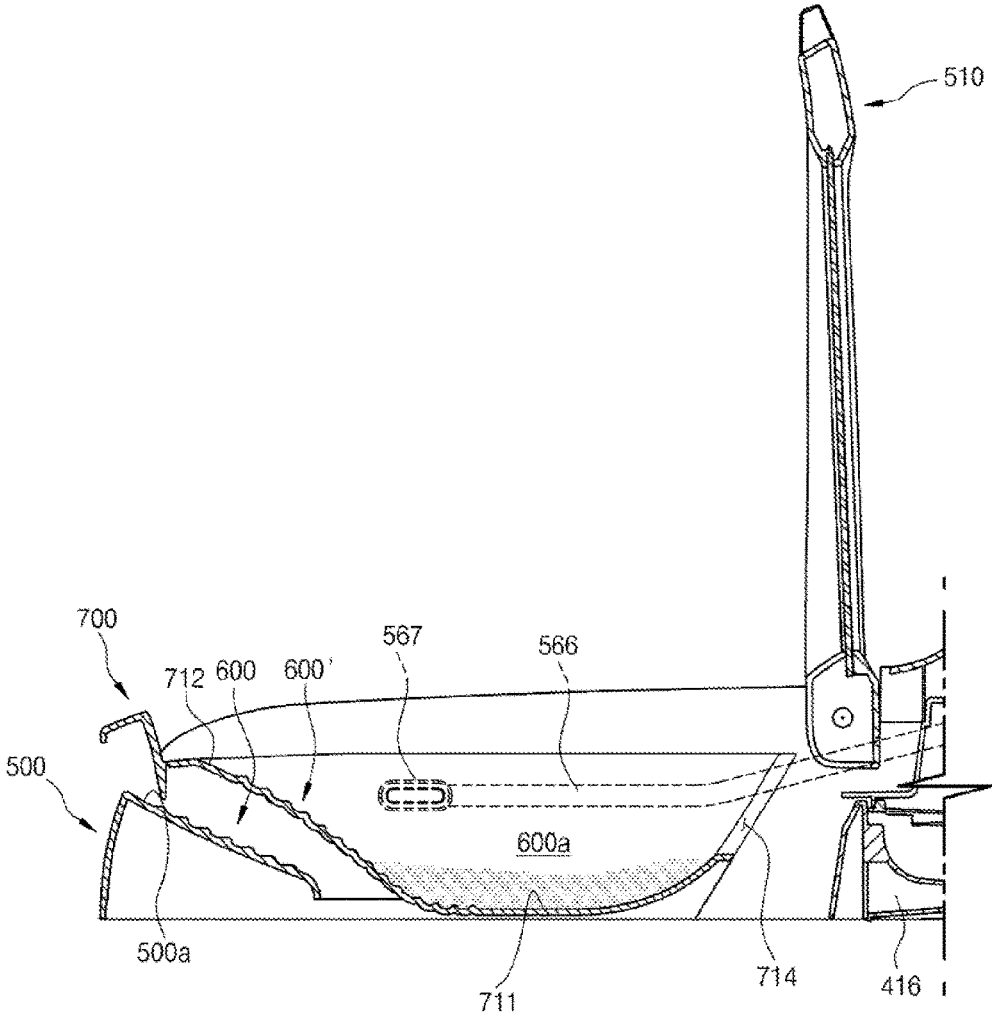
FIG. 29 illustrates an operation of the auxiliary washing unit of the washing machine according to the fifth embodiment.

FIG. 26 is a perspective view schematically illustrating a washing machine in which an auxiliary washing unit according to a fifth embodiment is installed, FIG. 27 is an exploded perspective view schematically illustrating the auxiliary washing unit of the washing machine according to the fifth embodiment, FIG. 28 is a cross-sectional view taken along line B-B' of FIG. 26, and FIG. 29 illustrates an operation of the auxiliary washing unit of the washing machine according to the fifth embodiment.

An auxiliary washing unit 700 may be detachably provided at the top cover assembly 500. An auxiliary washing part 600' for the auxiliary washing may be formed, and thus, if necessary, the auxiliary washing may be selectively performed by a user.

The auxiliary washing unit 700 may include a body 710 including a bottom part 711 and a side part 712 formed to be inclined toward the bottom part 711.

The auxiliary washing space 600*a* of the auxiliary washing unit 700 may be formed by the body 710. The bottom part 711 is a factor which determines a depth of the auxiliary washing space 600*a*. The bottom part 711 may be provided to be flat or curved. The side part 712 may be formed to be curved toward the bottom part 711.

The bottom part 711 and the side part 712 are provided to have the approximately concave auxiliary washing space 600*a*, to receive the washing water in the auxiliary washing space 600*a*, and thus to perform washing separately.

The auxiliary washing part 600' including frictional protrusions 601' may be formed at the side part 712 of the auxiliary washing unit 700. In an embodiment, an example in which the frictional protrusions 601' of the auxiliary washing part 600' are provided at the side part 712 has been described. However, an embodiment is not limited thereto. For example, the frictional protrusions 601' may be provided at an inner surface of the body 710 of the auxiliary washing unit 700.

The frictional protrusions 601' serve to increase frictional force with the laundry when the hand-washing is performed such that dirt is easily washed from the laundry. It is preferable that a plurality of frictional protrusions 601' be formed in parallel with each other.

Meanwhile, the auxiliary washing unit 700 may include a seating part 720 which is coupled with the top cover assembly 500.

The seating part 720 may be formed at an upper edge of the body 710.

The seating part 720 may be formed to have a flange 720*a* along the upper edge of the body 710 and thus to be seated on a seating surface 720*b* formed on an upper surface of the top cover assembly 500.

The seating surface 720*b* of the top cover assembly 500 may be formed so that an upper surface thereof has a flange shape to correspond to the flange 720*a* of the auxiliary washing unit 700.

Therefore, the seating part 720 formed at the upper edge of the auxiliary washing unit 700 may be seated on the seating surface 720*b* of the top cover assembly 500, and thus the auxiliary washing unit 700 may be stably supported.

Meanwhile, since the water supply device 560 which supplies the washing water to the auxiliary washing unit 700 and the method of supplying the washing water through the auxiliary water supply port 567 are the same as those of the above-described embodiment, the repeated description thereof will be omitted.

A washing water inlet 713 may be provided at the side part 712 of the auxiliary washing unit 700 to correspond to the auxiliary water supply port 567, such that the washing water supplied from the auxiliary water supply port 567 may be introduced into the auxiliary washing space 600*a* of the auxiliary washing unit 700.

Meanwhile, the auxiliary washing unit 700 may further include an auxiliary drain 714.

The auxiliary drain 714 may be provided to drain the washing water used in the auxiliary washing space 600*a*. The auxiliary drain 714 may be formed in a hole shape, and may be disposed at the bottom part 711 of the auxiliary washing space 600*a* so as to have a separate opening and closing member. In an embodiment, the auxiliary drain 714 may be provided at a rear side of the side part 712 of the body 710. However, a shape of the auxiliary drain 714 is not limited, and any shape with which the washing water stored in the auxiliary washing space 600*a* is discharged when the auxiliary washing unit 700 is tilted may be used.

Therefore, when the washing water is supplied to the auxiliary washing unit 700 through the washing water inlet 713, the preliminary washing may be performed using the frictional protrusions 601' of the auxiliary washing part 600', and when the preliminary washing is finished, the washing water may be drained through the auxiliary drain 714.

The auxiliary washing unit 700 may be formed of a thermoplastic resin. The auxiliary washing unit 700 may be formed of an ABS material. However, embodiments are not limited thereto, and the auxiliary washing unit 700 may be formed of any material having sufficient shock resistance and rigidity for hand-washing.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A washing machine comprising:

a main body having an opening through which to receive laundry into a main washing space to be machine washed by the washing machine;

a top cover disposed at an upper part of the main body over the opening and including an inner surface formed around the opening, wherein the inner surface includes a front inner surface, a side inner surface and a rear inner surface, and the top cover includes frictional protrusions on one of the front inner surface, the side inner surface and the rear inner surface to increase frictional force with laundry that is hand rubbed with the frictional protrusions;

a water supply device having a main water supply pipe to supply water to the main washing space and an auxiliary water supply pipe branched from the main water supply pipe to branch water supplied by the main water supply pipe; and an auxiliary water supply port in one of the front inner surface, the side inner surface and the rear inner surface that does not have the frictional protrusions thereon, and in communication with the auxiliary water supply pipe, to output the water branched by the auxiliary water supply pipe, wherein the one of the front inner surface, the side inner surface and the rear inner surface that does not have the frictional protrusions thereon is inclined at a slope toward the opening so that the water output from by the auxiliary water supply port runs down the one of the front inner surface, the side inner surface and the rear inner surface that does not have the frictional protrusions thereon.

2. The washing machine according to claim 1, wherein the frictional protrusions are formed on the front inner surface.

3. The washing machine according to claim 1, wherein the inner surface of the top cover is formed to be inclined downward toward the opening.

4. The washing machine according to claim 1, further comprising:

a door mounted on the top cover and configured to open and close the opening; and an auxiliary washing unit to hold laundry to be hand washed and configured to be positionable between the door and the top cover.

5. The washing machine according to claim 4, wherein the auxiliary washing unit is detachably mountable on the top cover.

6. The washing machine according to claim 5, wherein the top cover includes a seating surface on which the auxiliary washing unit is seatable, and the auxiliary washing unit includes a seating part supportable by the seating surface, so that, when the auxiliary washing unit is seated on the seating surface, the seating part is supported by the seating surface.

7. The washing machine according to claim 5, wherein, when the auxiliary washing unit is mounted on the top cover, the auxiliary washing unit overlaps the frictional protrusions.

8. The washing machine according to claim 5, wherein the auxiliary washing unit includes frictional protrusions and, when the auxiliary washing unit is mounted on the top cover, the frictional protrusions of the auxiliary washing unit are accessible for laundry to be hand rubbed therewith, and when the auxiliary washing unit is separated from the top cover, the frictional protrusions on the one of the front inner surface, the side inner surface and the rear inner surface of the inner surface of the top cover are accessible for laundry to be hand rubbed therewith.

9. The washing machine according to claim 1, further comprising:

an auxiliary washing unit seatable on the top cover, wherein the auxiliary washing unit has an auxiliary washing space configured to, when the auxiliary washing unit is seated on the top cover, receive the water output from the auxiliary water supply port, contain the received water, and hold laundry to be hand washed in the auxiliary washing space with the contained water, and the top cover is configured so that the frictional protrusions are covered by the auxiliary washing unit when the auxiliary washing unit is seated on the top cover.

10. The washing machine according to claim 2, further comprising:

an auxiliary washing unit seatable on the top cover, wherein the auxiliary washing unit has an auxiliary washing space configured to, when the auxiliary washing unit is seated on the top cover, receive the water output from the auxiliary water supply port, contain the received water, and hold laundry to be hand washed in the auxiliary washing space with the contained water, and the top cover is configured so that the frictional protrusions are covered by the auxiliary washing unit when the auxiliary washing unit is seated on the top cover.

11. The washing machine according to claim 3, further comprising:

an auxiliary washing unit seatable on the top cover, wherein the auxiliary washing unit has an auxiliary washing space configured to, when the auxiliary washing unit is seated on the top cover, receive the water output from the auxiliary water supply port, contain the received water, and hold laundry to be hand washed in the auxiliary washing space with the contained water, and the top cover is configured so that the frictional protrusions are covered by the auxiliary washing unit when the auxiliary washing unit is seated on the top cover.

12. The washing machine according to claim 4, wherein:

the auxiliary washing unit is seatable on the top cover, the auxiliary washing unit has an auxiliary washing space configured to, when the auxiliary washing unit is seated on the top cover, receive the water output from the auxiliary water supply port, contain the received water, and hold laundry to be hand washed in the auxiliary washing space with the contained water, and the top cover is configured so that the frictional protrusions are covered by the auxiliary washing unit when the auxiliary washing unit is seated on the top cover.

13. The washing machine according to claim 5, wherein:

the auxiliary washing unit has an auxiliary washing space configured to, when the auxiliary washing unit is mounted on the top cover, receive the water output from the auxiliary water supply port, contain the received water, and hold laundry to be hand washed in the auxiliary washing space with the contained water, and the top cover is configured so that the frictional protrusions are covered by the auxiliary washing unit when the auxiliary washing unit is mounted on the top cover.

14. The washing machine according to claim 6, wherein:

the auxiliary washing unit has an auxiliary washing space configured to, when the auxiliary washing unit is seated on the seating surface, receive the water output from the auxiliary water supply port, contain the received water, and hold laundry to be hand washed in the auxiliary washing space with the contained water, and the top cover is configured so that the frictional protrusions are covered by the auxiliary washing unit when the auxiliary washing unit is seated on the seating surface.

15. The washing machine according to claim 7, wherein:

the auxiliary washing unit has an auxiliary washing space configured to, when the auxiliary washing unit is mounted on the top cover, receive the water output from the auxiliary water supply port, contain the received water, and hold laundry to be hand washed in the auxiliary washing space with the contained water, and the top cover is configured so that the frictional protrusions are covered by the auxiliary washing unit when the auxiliary washing unit is mounted on the top cover.

16. The washing machine according to claim 8, wherein:

the auxiliary washing unit has an auxiliary washing space configured to, when the auxiliary washing unit is mounted on the top cover, receive the water output from the auxiliary water supply port, contain the received water, and hold laundry to be hand washed in the auxiliary washing space with the contained water, and the top cover is configured so that the frictional protrusions are covered by the auxiliary washing unit when the auxiliary washing unit is mounted on the top cover.

17. A washing machine comprising:

a main body having an opening through which to receive laundry into a main washing space to be machine washed by the washing machine;

a top cover disposed at an upper part of the main body over the opening, the top cover including an auxiliary washing part to perform hand washing, the auxiliary washing part having frictional protrusions to increase frictional force with laundry that is hand rubbed with the frictional protrusions;

a water supply device having a main water supply pipe to receive water directly from a water source external to the washing machine and to supply the received water to the main washing space, and an auxiliary water supply pipe branched from the main water supply pipe to branch, from the main water supply pipe, water received directly from the water source by the main water supply pipe; and an auxiliary water supply port in a surface of the top cover, at one side of the auxiliary washing part, and in communication with the auxiliary water supply pipe, to output the water branched by the auxiliary water supply pipe, wherein the surface of the top cover is inclined at a slope toward the opening so that the water output from by the auxiliary water supply port runs down the surface.

18. The washing machine according to claim 17, wherein the top cover includes an inner surface formed around the opening, and the frictional protrusions are formed on the inner surface.

19. The washing machine according to claim 18, wherein the frictional protrusions are formed at an inner front surface of the opening.

20. The washing machine according to claim 18, wherein the inner surface is formed to be inclined downward toward the opening.

21. The washing machine according to claim 18, further comprising:

a door mounted on the top cover and configured to open and close the opening; and an auxiliary washing unit to hold laundry to be hand washed and configured to be positionable between the door and the top cover.

22. The washing machine according to claim 21, wherein the auxiliary washing unit is detachably mountable on the top cover.

23. The washing machine according to claim 22, wherein the top cover includes a seating surface on which the auxiliary washing unit is seatable, and the auxiliary washing unit includes a seating part supportable by the seating surface, so that, when the auxiliary washing unit is seated on the seating surface, the seating part is supported by the seating surface.

24. The washing machine according to claim 22, wherein, when the auxiliary washing unit is mounted on the top cover, the auxiliary washing part of the top cover overlaps with the auxiliary washing unit.

25. The washing machine according to claim 22, wherein the auxiliary washing unit includes frictional protrusions and, when the auxiliary washing unit is mounted on the top cover, the frictional protrusions of the auxiliary washing unit are accessible for laundry to be hand rubbed therewith, and when the auxiliary washing unit is separated from the top cover, the frictional protrusions of the auxiliary washing part of the top cover are accessible for laundry to be hand rubbed therewith.

* * * * *